US006609777B2

(12) United States Patent
Endo

(10) Patent No.: US 6,609,777 B2
(45) Date of Patent: Aug. 26, 2003

(54) DETERMINATION OF RECORDING POSITION MISALIGNMENT ADJUSTMENT VALUE IN MAIN SCANNING FORWARD AND REVERSE PASSES

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/162,198

(22) Filed: Jun. 5, 2002

(65) Prior Publication Data

US 2002/0186269 A1 Dec. 12, 2002

(30) Foreign Application Priority Data

Jun. 6, 2001 (JP) ..... 2001-170825

(51) Int. Cl.[7] ..... B41J 29/393
(52) U.S. Cl. ..... 347/19
(58) Field of Search ..... 347/19, 14, 10, 347/11, 12, 81, 23, 40, 20, 6, 37; 400/74, 279; 250/573

(56) References Cited

U.S. PATENT DOCUMENTS 6,513,900 B2 * 2/2001 Endo et al. ..... 347/19

FOREIGN PATENT DOCUMENTS

EP 0 925 929 A2 * 12/1998 ..... 347/19

* cited by examiner

*Primary Examiner*—Raquel Yvette Gordon
*Assistant Examiner*—Charles W. Stewart, Jr.
(74) *Attorney, Agent, or Firm*—Sughrue Mion, PLLC

(57) ABSTRACT

The printing in which dots are formed on a recording medium through the ejection of ink droplets from nozzles is performed. The adjustment value to adjust recording position misalignment in the main scanning direction in such printing is determined automatically. An ink droplet is expelled according to a fixed cycle from a nozzle n0 while the print head is being conveyed in the forward pass of main scanning. The detection time $t_{fp}$ at which the ink droplet crosses a laser beam L is measured. Similarly, an ink droplet is expelled according to a fixed cycle from the nozzle n0 while the print head is being conveyed in the reverse pass of main scanning. The detection time $t_{bp}$ at which the ink droplet crosses the laser beam L is measured. The ink droplet ejection timing adjustment value can be obtained from these measurement values $t_{fp}$ and $t_{bp}$ and from the carriage position at these times.

15 Claims, 14 Drawing Sheets

DETERMINATION OF RECORDING POSITION MISALIGNMENT ADJUSTMENT VALUE IN MAIN SCANNING FORWARD AND REVERSE PASSES

BACK GROUND OF THE INVENTION

1. Field of the Invention

The present invention relates to technology for printing by forming dots on a printing medium while performing a main scan, and more particularly relates to technology to determine the adjustment value for correcting the misalignment of the dot recording positions in the main scanning direction.

2. Description of the Related Art

In recent years, as computer output devices, there has been a broad popularization of printers of the type that eject ink from a head. Among this type of color printer, there are printers that print an image by forming dots on a printing medium by ejecting ink drops from a nozzle while performing a main scan in both the forward and reverse scanning passes.

In a printer in which dots are formed on a printing medium through the ejection of ink droplets from nozzles, dot recording position misalignment can occur due to deviation of the direction in which ink droplets are ejected, backlash of the driving mechanism in the main scanning direction, and warping of the platen that supports the printing medium from below. As a technology to resolve this position misalignment, the technology disclosed by the inventors in Japanese application JPA 5-69625 is known. In this conventional technology, the adjustment value used to eliminate the dot formation position misalignment in the main scanning direction are preset, and the recording positions in the forward and reverse scanning passes are corrected based on the adjustment value.

However, in the conventional adjustment value determination method, the adjustment value must be determined by the user based on observation of the printing results, and the adjustment value cannot be automatically determined.

Accordingly, an object of the present invention is to automatically carry out determination of the adjustment value to adjust recording position misalignment in the main scanning direction when printing is performed in which dots are formed on a printing medium through the ejection of ink droplets from nozzles.

SUMMARY OF THE INVENTION

In order to resolve at least a part of the problem described above, the present invention executes prescribed processing using a printing apparatus having a print head with nozzles. This printing apparatus includes a print head having nozzles that eject ink droplets; an inspection unit that optically detects the passage of ink droplets ejected from one of the nozzles; a head driving unit that drives the nozzles to eject ink droplets; a main scanning driving unit that performs main scanning in which the print head is moved relative to the inspection unit; a timer; and a controller that controls the print head, the inspection unit, the head driving unit, the main scanning driving unit and the timer.

In the printing apparatus described above, a forward pass test is performed in which ink droplets are detected using the inspection unit while ejecting ink droplets from one of the nozzles and moving the print head along the forward pass of main scanning. A reverse pass test is performed in which ink droplets are detected using the inspection unit while ejecting ink droplets from one of the nozzles and moving the print head along the reverse pass of main scanning. The adjustment value is then determined based on the results of the forward pass test and the reverse pass test. According to this aspect, the adjustment value of the dot formation position misalignment can be automatically determined without the need for human visual review.

It is preferable to identify a detection time $t_{fp}$ at which the ink droplets were detected by the inspection unit in the forward pass test. It is also preferable to identify a detection time $t_{bp}$ at which the ink droplets were detected by the inspection unit in the reverse pass test. The adjustment value is then preferably determined using the detection time $t_{fp}$ and the detection time $t_{bp}$. According to this aspect, the dot formation position misalignment adjustment value can be calculated based on the measurement values $t_{fp}$ and $t_{bp}$.

It is preferable that the adjustment value is calculated based on the following values: a reference eject time $t_{f0}$ of the ink droplet is to be identified by the inspection unit in the forward pass test under a reference condition of the dot formation position misalignment adjustment; a reference eject time $t_{b0}$ of the ink droplet is to be identified by the inspection unit in the reverse pass test under the reference condition; the detection time $t_{fp}$, and $t_{bp}$; a distance HP between a particular nozzle and a surface of the printing medium when the particular nozzle is positioned facing the printing medium; and an ink droplet velocity component Vk in a direction connecting a nozzle to be inspected and a detection position of the inspection unit when the nozzle to be inspected is closest to the detection position. According to this aspect, the adjustment value can be determined based on the predetermined values and the measurement values obtained in the forward pass test and the reverse pass test.

It is preferable to identify a position $P_{fp}$ of the nozzle at the detection time tfp in the forward pass test. It is also preferable to identify a position $P_{bp}$ of the nozzle at the detection time $t_{bp}$ in the reverse pass test. The adjustment value is then determined using the position $P_{fp}$ and the position $P_{bp}$. According to this aspect, the dot formation position misalignment adjustment value can also be calculated based on the measurement values $P_{fp}$ and $P_{bp}$.

In the determination of the adjustment value, it is preferable that the adjustment value calculated based on following values: a reference position $P_{f0}$ at which the nozzle ejects the ink droplet that is to be identified by the inspection unit in the forward pass test under a reference condition of the dot formation position misalignment adjustment; a reference position $P_{b0}$ at which the nozzle ejects the ink droplet that is to be identified by the inspection unit in the reverse pass test under the reference condition; the position $P_{fp}$, and $P_{bp}$; a distance HP between a particular nozzle and a surface of the printing medium when the particular nozzle is positioned facing the printing medium; the shortest distance HL between the nozzle and detection position of the inspection unit; an ink droplet velocity component Vk in a direction connecting the nozzle and the detection position when the nozzle is closest to the detection position; and the relative velocity Vc of the print head relative to the printing medium during the main scanning. According to this aspect, the adjustment value can be determined based on the predetermined values and the measurement values obtained in the forward pass test and the reverse pass test.

The present invention can be implemented in the various forms indicated below.

(1) Adjustment value determination method, printing method, print control method (2) Printing apparatus, print control apparatus
(3) Computer program to implement the above apparatuses and methods
(4) Recording medium on which is recorded the computer program to implement the above apparatuses and methods
(5) Data signals that are embodied in transmission waves, including the computer program to implement the above apparatuses and methods These and other objects, features, aspects, and advantages of the present invention will become more apparent from the following detailed description of the preferred embodiments with the accompanying drawings.

DESCRIPTION OF THE PREFERRED EMBODIMENT

Embodiments of the present invention will be explained in the following sequence below based on examples.

Figure 1:
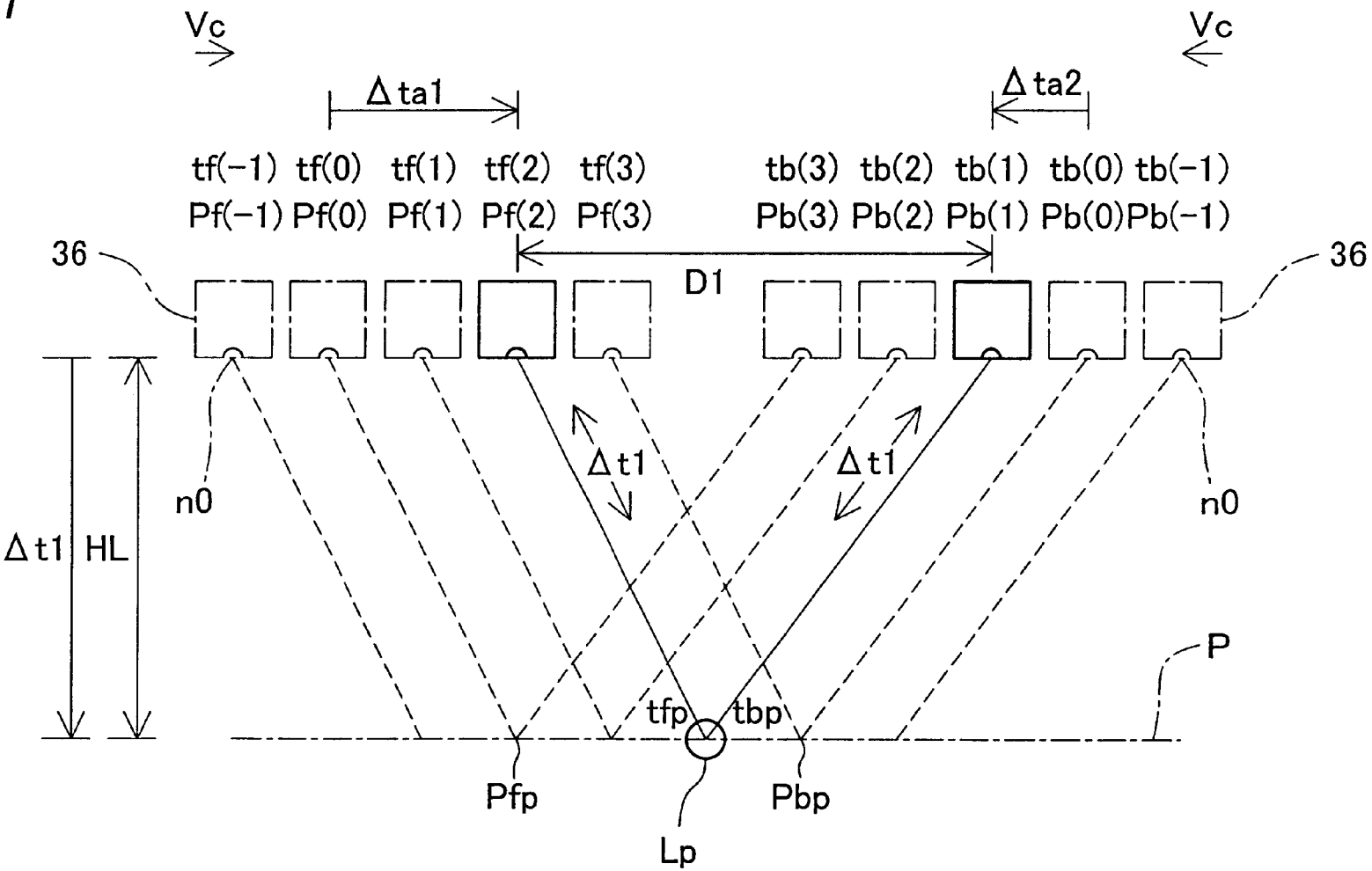
FIG. 1 is an explanatory drawing of the forward pass test and the reverse pass test used to determine adjustment value.

A. Summary of the invention
B. First embodiment:
  B-1. Construction of the apparatus:
  B-2. Dot loss inspection:
  B-3. Occurrence of recording misalignment during bi-directional printing:
  B-4. Determination of adjustment value:
  B-5. Adjustment of ink droplet ejection timing in reverse pass
C. Second embodiment:
D. Third embodiment:
E. Fourth embodiment
F. Variations
  F-1. Variation 1:
  F-2. Variation 2:
  F-3. Variation 3:
  F-4. Variation 4:

A. Summary of the Invention:

FIG. 1 is an explanatory drawing of the forward pass test and the reverse pass test by which to determine the adjustment value. Ink droplets are ejected from the nozzle n0 according to a certain cycle while the print head 36 is being conveyed along the forward pass of main scanning. The velocity component of an ink droplet along to the direction of the distance HL between the moving path of the head 36 and the laser beam L, and the time interval between the ejection of an ink drop and the moment that it passes the laser beam L are assumed to be fixed, and not dependent on deviations in the direction of ink droplet ejection. Therefore, the time tf(2) at which an ink droplet that crosses the laser beam L is ejected from the nozzle is obtained via calculation based on the detection time $t_{fp}$ at which the ink droplet passes therethrough. Similarly, ink drops are ejected while the print head 36 is being conveyed along the reverse pass of main scanning. The time tb(1) at which an ink droplet that crosses the laser beam L is ejected from the nozzle is accordingly obtained via calculation based on the detection time $t_{bp}$ at which the ink droplet passes therethrough.

The ejection time at which an ink droplet should pass the laser beam L along the reverse pass under the default dot formation position misalignment adjustment condition is referred as tf(0), and similarly the ejection time in the reverse pass is referred as tb(0). In the forward pass, if the timing of ink droplet ejection is delayed by Δta2=(tb(1)−tb(0)) from the default situation, the ink droplet can be ejected aiming the laser beam L and made to actually cross the laser beam L. In the reverse pass, if the timing of ink droplet ejection is delayed by Δta1=(tf(2)−tf(0)) from the default situation, the ink droplet can be ejected aiming the laser beam L and made to actually cross the laser beam L. Where the timing of ink droplet ejection can be adjusted for either the forward pass or the reverse pass only, in either case, if the ink droplet ejection timing is delayed by Δta1+Δta2, the ink droplets ejected aiming the same point during scannings in the forward pass and the reverse pass actually pass the same point.

Figure 2:
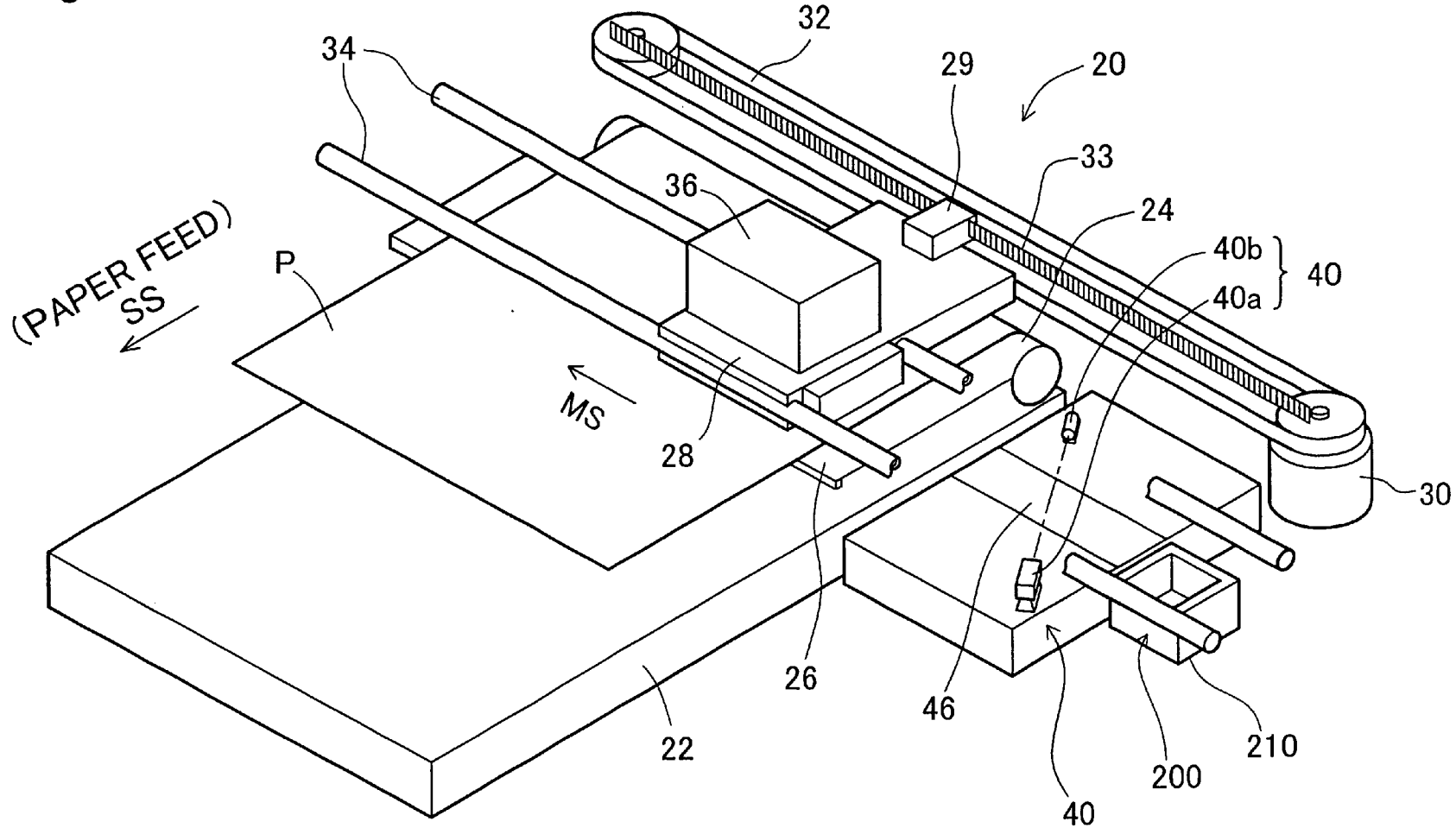
FIG. 2 is a summary perspective view showing the main components of the color inkjet printer 20 comprising one embodiment of the present invention.

B. First Embodiment:

B-1. Construction of Apparatus:

FIG. 2 is a summary perspective view showing the construction of a color inkjet printer 20 comprising one embodiment of the present invention. This inkjet printer 20 includes a paper stacker 22, a paper feed roller 24 driven by a step motor not shown, a platen 26, a carriage 28, a step motor 30, a tractor belt 32 driven by the step motor 30, guide rails 34 to guide the carriage 28, and an encoding plate 33 aligned along the guide rails. A print head 36 having multiple nozzles and an encoder 29 for reading the encoding plate 33 are installed on the carriage 28.

The printing paper P is wound from the paper stacker 22 by the paper feed roller 24, and is fed in one direction on the surface of the platen 26. This direction is called the 'sub-scanning direction'. The carriage 28 is pulled by the tractor belt 32 driven by the step motor 30, and is moved along the guide rails in the direction perpendicular to the sub-scanning direction. This direction perpendicular to the sub-scanning direction is termed the 'main scanning direction'. The printing performed by the print head 36 is carried out on the printing paper P located on the platen 26 during main scanning. The region on the platen P in which printing is carried out is termed the 'print region'.

A dot loss inspection unit 40 and a cleaning mechanism 200 are located outside the print region (to the right in FIG. 2). In FIG. 2, with regard to the cleaning mechanism 200, only the head cap 210 is shown, and the other components are omitted. Along the path of movement of the print head 36 along the guide rails 34 in the main scanning direction, the region in which the dot loss inspection unit 40 and the head cap 210 are located is termed the 'adjustment region' as opposed to the 'print region' described above.

The dot loss inspection unit 40 has an ink receiving area 46 located such that it faces the two guide rails 34. This ink receiving area 46 receives ink droplets that are ejected from the print head 36 when an ink droplet ejection test is performed, or when a forward pass test or a reverse pass test to determine the adjustment value is carried out. The dot loss inspection unit 40 also has a photoemitter 40*a* and a photoreceptor 40*b*. This photoemitter 40*a* and photoreceptor 40*b* are located such that they face each other while sandwiching the ink receiving area 46 between them.

The photoemitter 40*a* emits a laser beam, and the photoreceptor 40*b* receives this laser beam. It is sufficient if the photoemitter 40*a* can emit light, and may comprise, for example, a semiconductor laser that can emit red light having a wavelength of 650 nm at a maximum output of 7 mW. The semiconductor laser may be a Sharp GH06507A2B model driven by a model IR3C07N driver IC with a built-in APC manufactured by Sharp. The photoreceptor 40*b* may comprise a device, such as a photodiode, that can change the output in accordance with the amount of light received. For example, a Sharp IS456 device may be used. In other words, the inspection unit 40 may comprise a unit that can detect the passage of an ink droplet past a prescribed inspection position.

The laser beam emitted from the photoemitter 40*a* and received by the photoreceptor 40*b* crosses the space between the two guide rails 34 and the ink receiving area 46 at an angle of approximately 26° relative to the sub-scanning direction. When the print head 36 is positioned on the guide rails 34 above the laser beam, the laser beam crosses the area 1 mm below the bottom surface of the print head 36. The height position of this laser beam is the same as the height position of the surface of the printing paper P. Because each nozzle array in the print head 36 is aligned along the sub-scanning direction, the laser beam forms an angle of approximately 26° relative to the direction of nozzle array alignment. The region above the ink receiving area 46 is termed the 'inspection region' in the range of movement of the print head 36 in the main scanning direction along the guide rails 34, because the ink drop injection inspection takes place in a region above the ink receiving area 46 using the laser beam. The detailed construction of the dot loss inspection unit 40 and the method of dot loss inspection will be described below. In addition, in FIG. 2, other component elements of the dot loss inspection unit 40 are omitted.

Slits are formed at prescribed intervals in the encoding plate 33 located along the guide rails 34. A photoemitting diode and a photodiode that sandwich the encoding plate 33 are located in the encoder 29, which straddles the encoding plate 33. The encoder 29 can detect the position of the carriage 28 along the main scanning direction based on the number of times that the light emitted by the photoemitting diode passes a slit in the encoding plate 33 and is received by the photodiode and the number of times that the emitted light is interrupted by the encoding plate 33. In other words, the positions of the print head 36 mounted to the carriage 28 and of each nozzle located on the print head 36 can be detected. In this embodiment, an optical linear encoder 29 is used as the means to detect the position of the print head 36, but the position sensor is not limited to this construction, and may alternatively comprise a magne-scale. In other words, the position sensor may comprise any device that can detect the position of the print head during main scanning.

Figure 3:
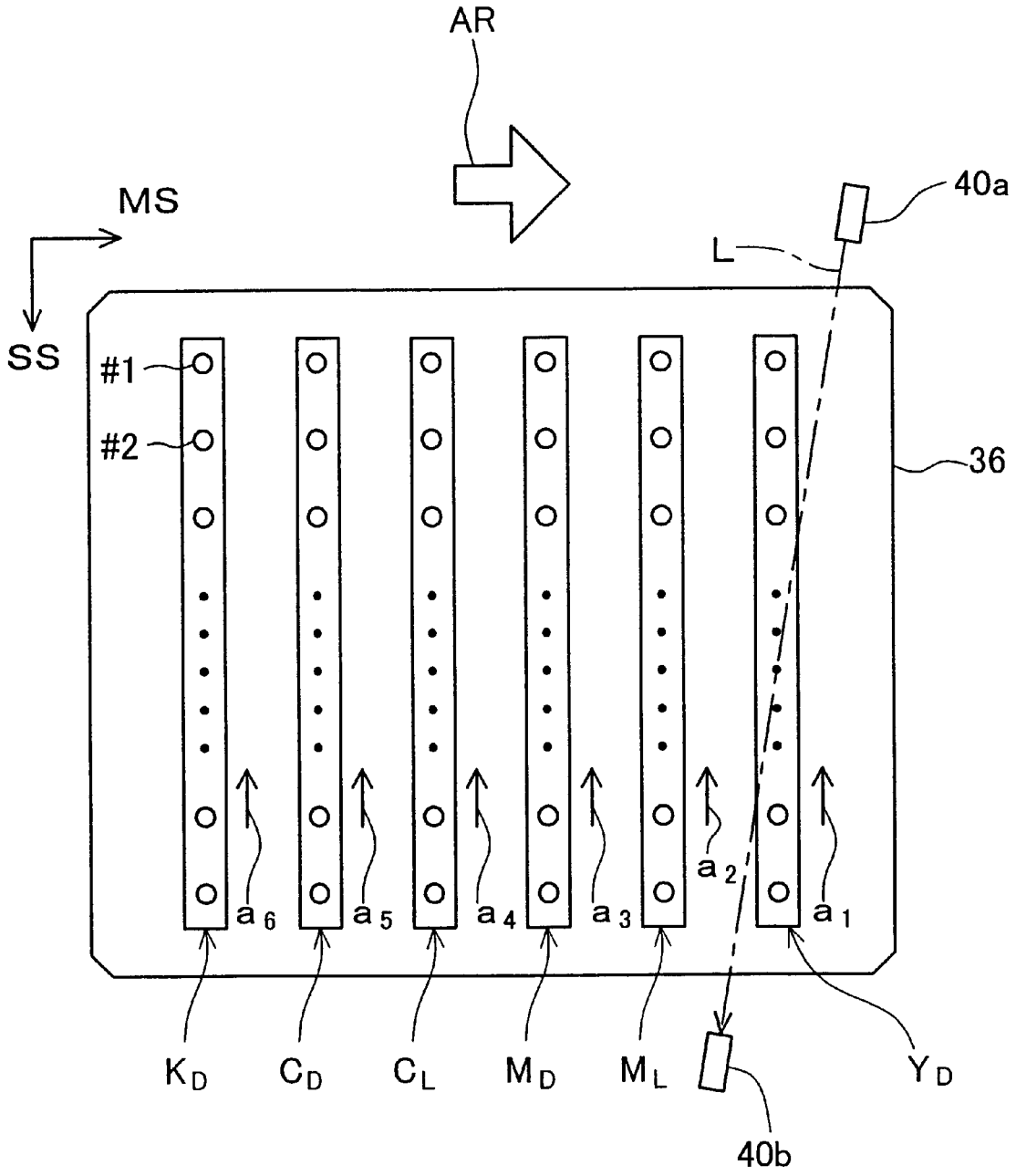
FIG. 3 is a drawing showing the print head 36 from the bottom surface thereof.

FIG. 3 is a drawing showing the print head 36 from the bottom surface thereof. Formed on the bottom surface of the print head 36 are a black ink nozzle group $K_D$ that ejects black ink, a dark cyan ink nozzle group $C_D$ that ejects dark cyan ink, a light cyan ink nozzle group $C_D$ that ejects dark cyan ink, a dark magenta ink nozzle group $M_D$ that ejects dark cyan ink, a light magenta ink nozzle group $M_L$ that ejects light cyan ink, and a yellow ink nozzle group $Y_D$ that ejects yellow ink.

The multiple nozzles contained in each nozzle group each comprise one nozzle array aligned in the sub-scanning direction SS. During printing, ink droplets are ejected from each nozzle while the carriage 28 (see FIG. 2) and the print head 36 travel in the main scanning direction MS.

Figure 4:
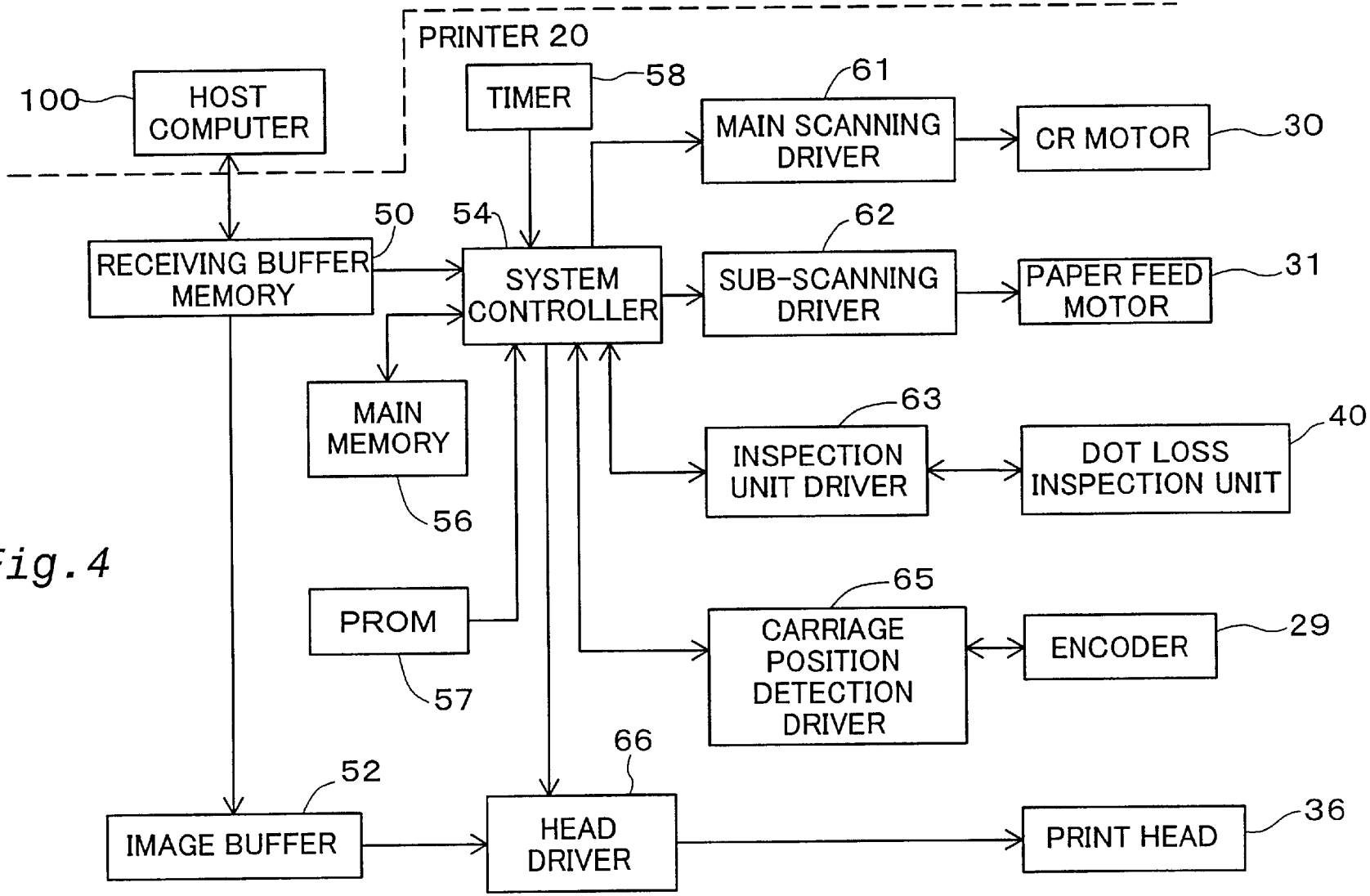
FIG. 4 is a block diagram showing the electrical components of the printer 20.

FIG. 4 is a block diagram showing the electrical construction of the printer 20. The printer 20 includes a receiving buffer memory 50 that receives signals supplied by the host computer 100, an image buffer 52 that stores print data, a system controller 54 that controls the overall operation of the printer 20, a main memory 56, a PROM 57 and a timer 58.

Figure 5:
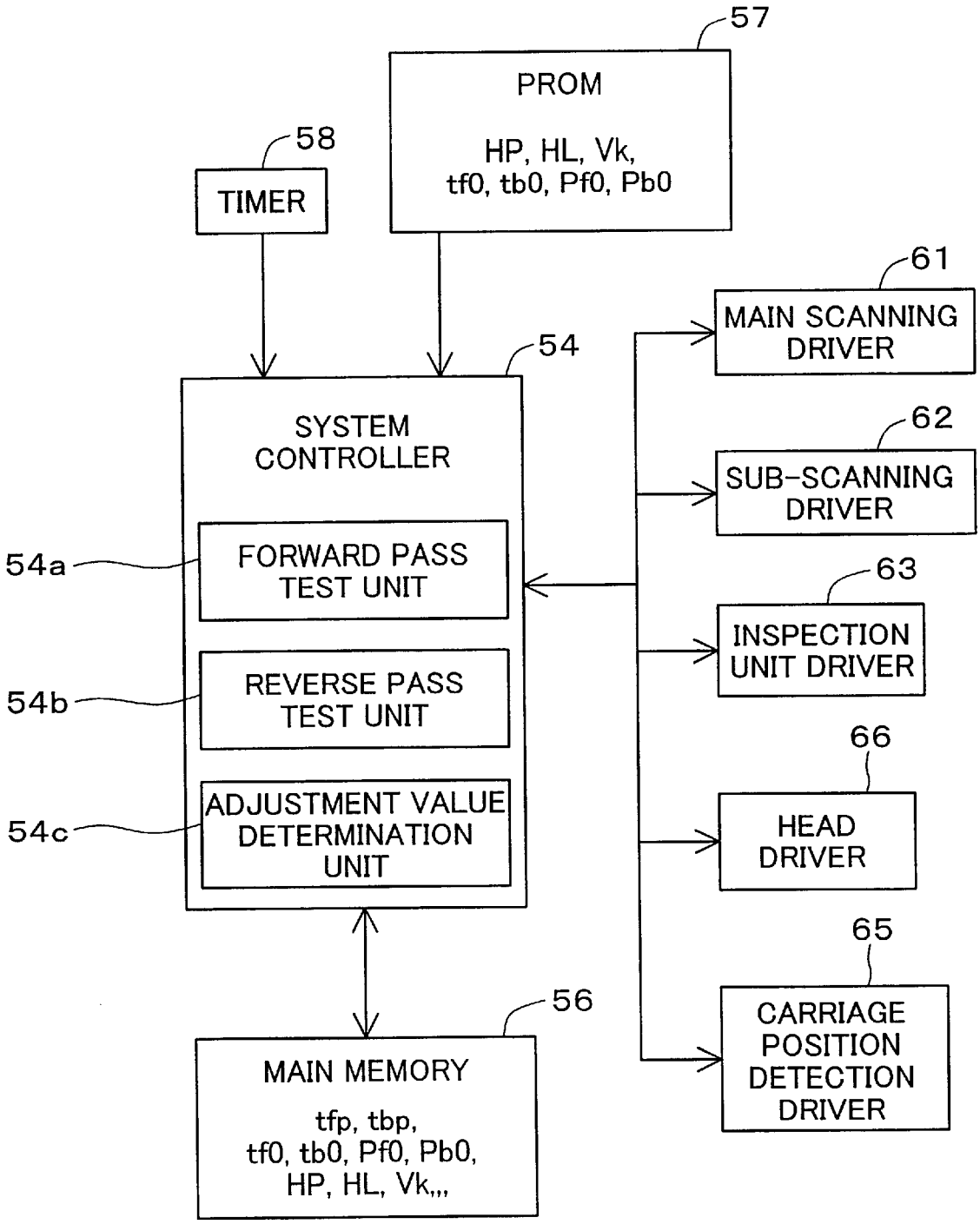
FIG. 5 is a block diagram showing the relationship between the system controller 54 and each driver.

FIG. 5 is a block diagram showing the relationship between the system controller 54 and each driver. As shown in FIG. 4 and FIG. 5, connected to the system controller 54 are a main scanning driver 61 that drives the carriage motor 30, a sub-scanning driver 62 that drives the paper feed motor 31, an inspection unit driver 63 that drives the dot loss inspection unit 40, a head driver 66 that drives the print head 36, and a carriage position detection driver 65 that processes signals from the encoder 29. Also connected to the system controller 54 are the main memory 56, the PROM 57 and the timer 58. The system controller 54 functions as a forward pass test unit 54*a*, a reverse pass test unit 54*b* and an adjustment value determining unit 54*c*. These functional units control the main scanning driver 61, the sub-scanning driver 62, the inspection unit driver 63, the head driver 66, and the carriage position detection driver 65, and cause them to perform prescribed operations. The operations performed by these functional units are described below.

The printer driver (not shown) in the host computer 100 shown in FIG. 4 determines various parameter values that define printing operations, based on print mode set by the user (high-speed print mode, high-image quality print mode, etc.). This printer driver also generates print data to perform printing in the set print mode based on these parameter values, and forwards this print data to the printer 20. The forwarded print data is stored temporarily in the receiving buffer memory 50. In the printer 20, the system controller 54 reads out necessary information from the print data in the receiving buffer 50 and sends control signals to each driver based thereon.

Print data for multiple color components is made through decomposing the print data received by the receiving buffer with each component color. The print data for multiple color components is then stored in the image buffer 52. The head driver 66 reads out from the image buffer 52 each item of color component image data based on control signals from the system controller 54 and drives each color-based nozzle array located on the print head 36 in accordance therewith.

B-2. Dot Loss Inspection:

The construction of the dot loss inspection unit 40 and the principle of the inspection method carried out by the dot loss inspection unit 40 will be described below with reference to FIG. 3. Drawn in simplified fashion in FIG. 3 are nozzle arrays for the six color components in the print head 36 and a photoemitter 40*a* and a photoreceptor 40*b* comprising the first dot loss inspection unit 40.

The photoemitter 40*a* is a laser that emits a light beam L having a diameter of 1 mm or less at the emitting position of the apparatus. This laser beam L is emitted in a direction that forms an angle of approximately 26° relative to the sub-scanning direction SS, and is received by the photoreceptor 40*b*, as shown in FIG. 3. In other words, the laser beam L is emitted in a direction that forms an angle of approximately 26° relative to each nozzle array aligned with the sub-scanning direction SS. In addition, the laser beam L is emitted within a plane having the same height position as the surface of the printing paper P placed on the platen 26.

When an ink droplet is ejected normally from a nozzle within an expected range therebelow, the ejected ink droplet crosses the ink droplet detection space of the laser beam L, and the light received by the photoreceptor 40*b* is temporarily blocked or weakened. This makes the amount of light received to fall below a prescribed threshold value. When this occurs, it can be determined that there is no clogging with regard to that nozzle. On the other hand, when the amount of light received by the photoreceptor 40*b* during the driving period for a given nozzle exceeds or equals the prescribed threshold, it is determined that there may be clogging with regard to that nozzle.

In this specification, for the sake of convenience, the direction from the print head 36 to the platen 26, or to the printing paper P located on the platen 26, is termed 'down.' The surface of the print head 36 that faces the platen 26 is termed the 'bottom surface' thereof. Furthermore, the direction that links the print head 36 and the platen 26 is termed the 'perpendicular direction', and the position in the direction that links the print head 36 and the platen 26, as measured from the platen 26, is termed the 'height' or 'height position.' However, these appellations are used only for the sake of convenience, and do not restrict the orientation of setting of the printer 20. Therefore, for example, the ink droplet ejection velocity component Vk is not limited to a velocity component in the direction of gravity, and may comprise an ink droplet velocity component in the direction linking the nozzle n0 and the center area Lp of the laser beam L when the nozzle n0 is closest to the center area Lp (the detection position) of the laser beam L in the sub-scanning direction.

B-3. Occurrence of Recording Misalignment During Bi-directional Printing

In the first embodiment, the recording offset during bi-directional printing is adjusted. Accordingly, the occurrence of recording misalignment during bi-directional printing will be explained first.

Figure 6A:
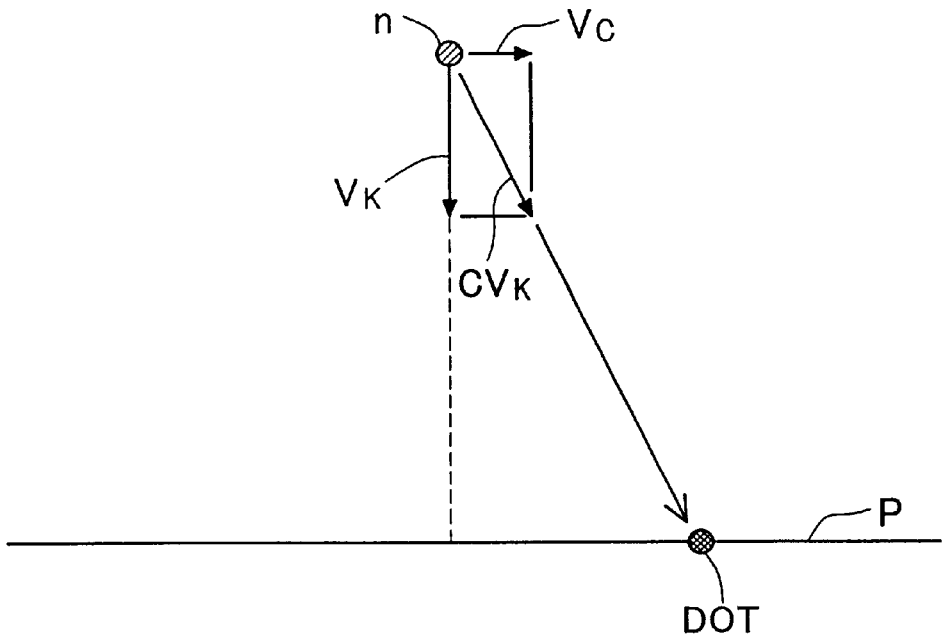
FIG. 6A is an explanatory drawing showing the dot impact position during printing along the forward pass.
Figure 6B:
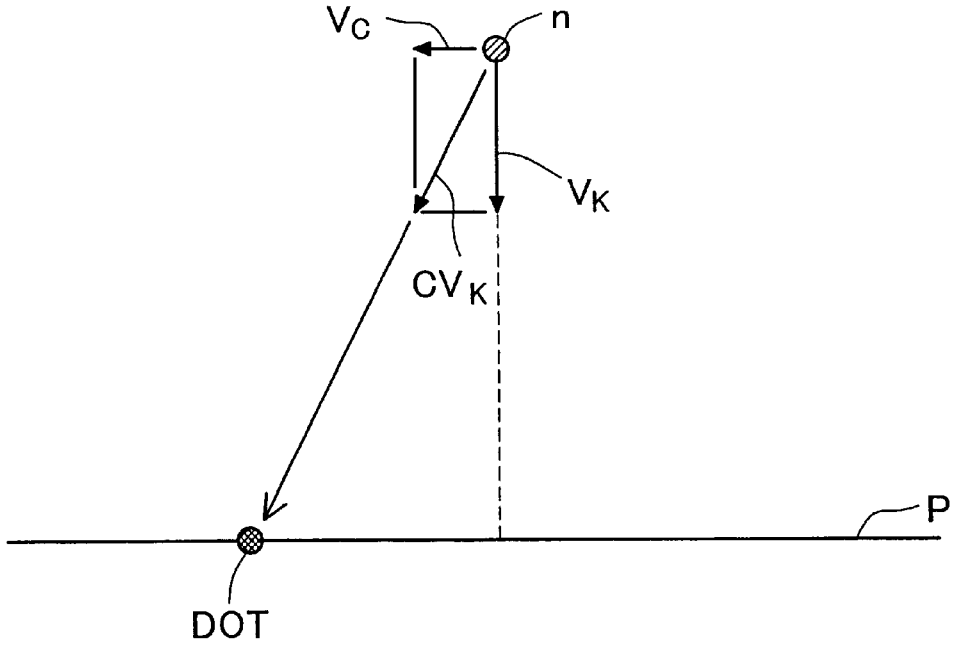
FIG. 6B is an explanatory drawing showing the dot impact position during printing along the reverse pass.

FIG. 6A shows the dot impact position during printing along the forward pass, and FIG. 6B shows the dot impact position during printing along the reverse pass. The nozzle (n) moves horizontally in two directions above the printing paper P, and dots are formed on the printing paper P through the ejection of ink during movement of the nozzle (n) along the forward pass and along the reverse pass. The ink is assumed to be ejected in the perpendicular direction at an ejection velocity of Vk. Each ink compound vector CVk is a combination of the downward ink ejection velocity vector Vk and the velocity vector Vc of the nozzle (n) during main scanning. Therefore, when ink droplets are ejected during forward pass movement and reverse pass movement from the identical relative position of the print head 36 to the printing paper P, the ink impact positions of the ink droplets on the printing medium will be offset from each other. Consequently, in order to match the ink impact positions of the ink droplets on the printing medium, it is preferable that the timings of ink droplet ejection during forward pass movement and reverse pass movement are to be adjusted.

In FIG. 6, the dot formation position misalignments during forward and reverse pass movement are symmetrical relative to the nozzle position at the time of ink droplet ejection. However, this offset during forward and reverse pass movement is sometimes not symmetrical, due to such factors as deviations in the direction in which the ink droplet is ejected from the nozzle, backlash of the driving mechanism in the main scanning direction, or warping of the platen that supports the printing medium. Adjustment of the timing of ink droplet ejection during forward pass movement and reverse pass movement is also desirable in order to compensate for dot formation position misalignment caused by these factors.

Figure 7:
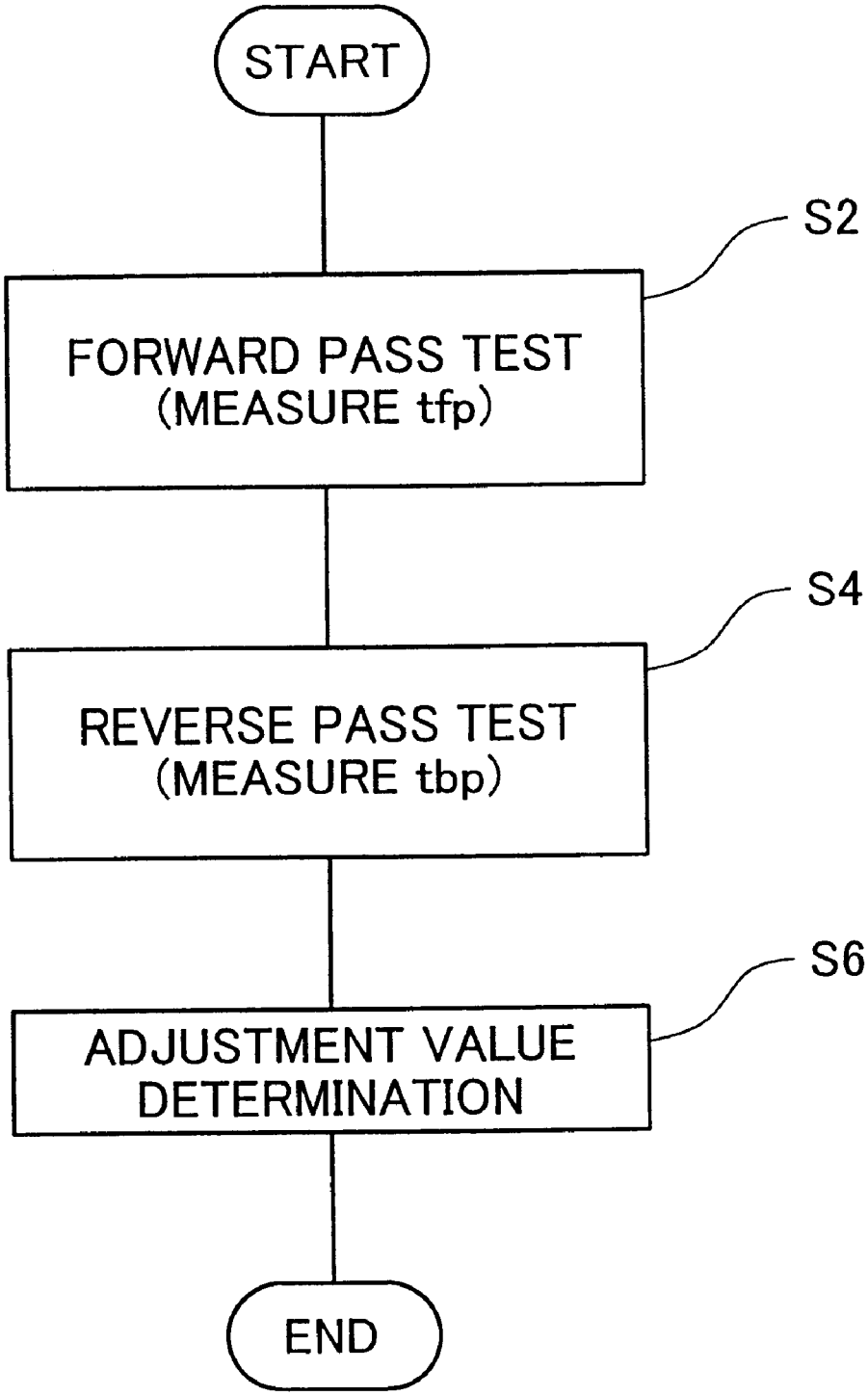
FIG. 7 is a flow chart showing the processes by which the adjustment value is determined.

B-4. Determination of Adjustment Value:

FIG. 7 is a flow chart showing the processes by which the adjustment value is determined. First, the forward pass test is performed in step S2. The reverse pass test is then performed in S4. The adjustment value is then determined in S6 based on the measurement values obtained in the forward pass test and the reverse pass test. Each of these processes will be explained below.

Figure 8:
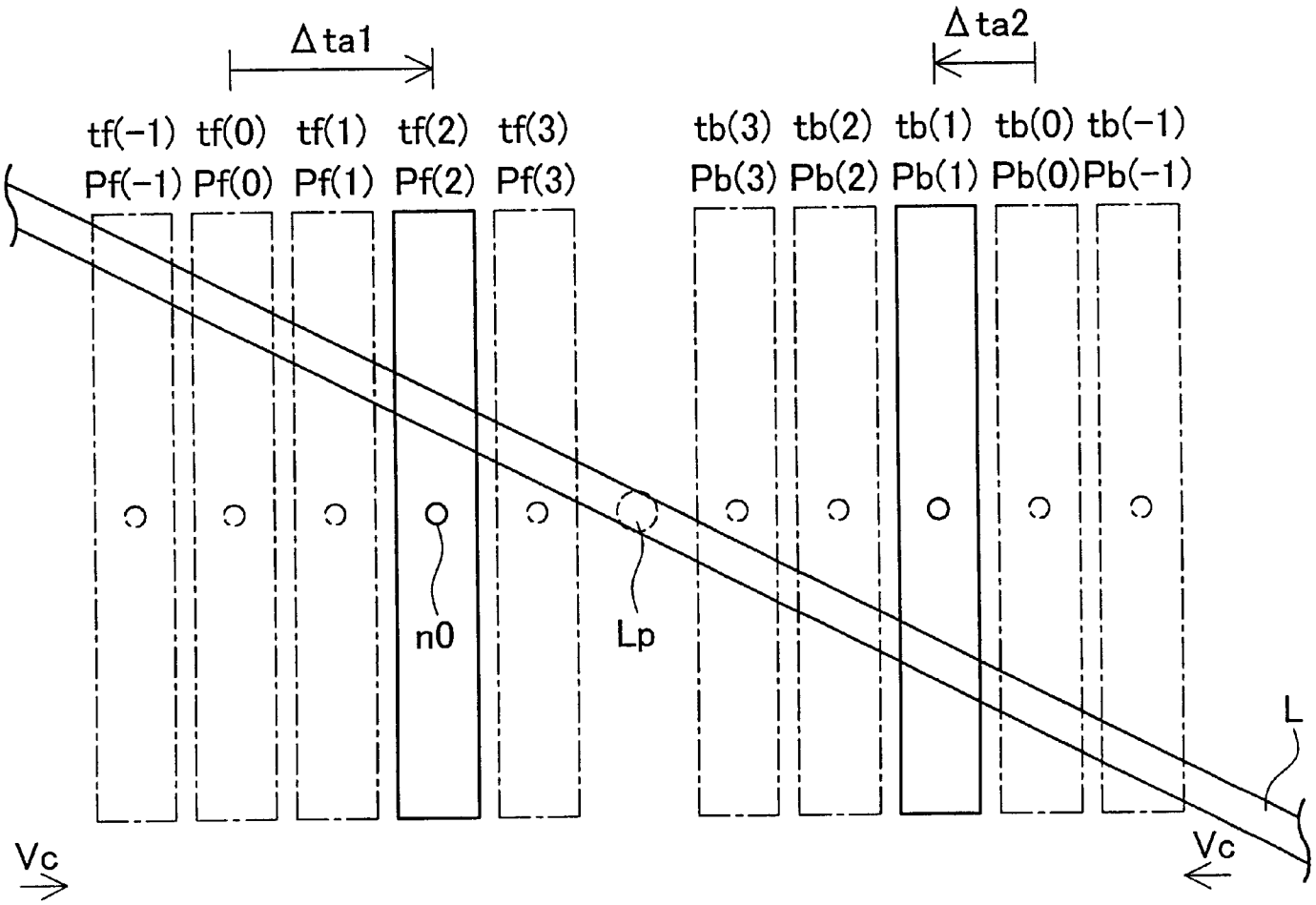
FIG. 8 is an explanatory drawing of the forward pass test and the reverse pass test used to determine the adjustment value.

FIG. 8 is an explanatory drawing of the forward pass test and the reverse pass test used to determine the adjustment value. While FIG. 1 is viewed from the side surface of the print head, FIG. 8 is viewed from the top surface of the print head. In FIG. 1 and FIG. 8, for purposes of simplification, the print head is shown as a vertically long rectangle having a single nozzle array. Furthermore, only the center nozzle n0 used in the tests is shown among the multiple nozzles in the nozzle array. In FIG. 1, only the area of the laser beam L positioned directly below the nozzle n0, i.e., the center area Lp (see FIG. 8) is shown. The term 'center' of 'the center area Lp' means the center along the sub-scanning direction. The center area Lp of the laser beam L along the sub-scanning direction is equivalent to the 'detection position' referred to in the claims. In the first embodiment, because the tests are performed using the nozzle n0, which is positioned in the center along the sub-scanning direction, the center area Lp of the laser beam L along the sub-scanning direction corresponds to the 'detection position'. However, the detection position may be set to a different position in accordance with the position of the nozzle used for the test. In the first embodiment, the distance between the bottom surface of the print head 36 and the laser beam L is set to be equal to the distance between the bottom surface of the print head 36 and the printing paper P located on the platen. This distance between the print head 36 bottom surface and the laser beam L is referred as HL. In FIG. 1, the position of the printing paper P is hypothetically indicated by the chain-dot line.

In the forward pass test used to determine the adjustment value regarding forward pass ink ejection timing, ink droplets are ejected from the nozzle n0 in the center of the nozzle array according to a certain cycle while the print head 36 is being conveyed at a fixed speed along the forward pass of main scanning (the direction from left to right in FIG. 1 and FIG. 8). The ink droplet ejection time is referred as tf(0) at which the ink droplet should pass the laser beam L under the default dot formation position misalignment adjustment condition. The default dot formation position misalignment adjustment condition means the adjustment condition that is set at the time of shipment from the factory. In the reverse pass test, ink droplets are ejected at several points in time before and after the above timing tf(0).

Figure 9:
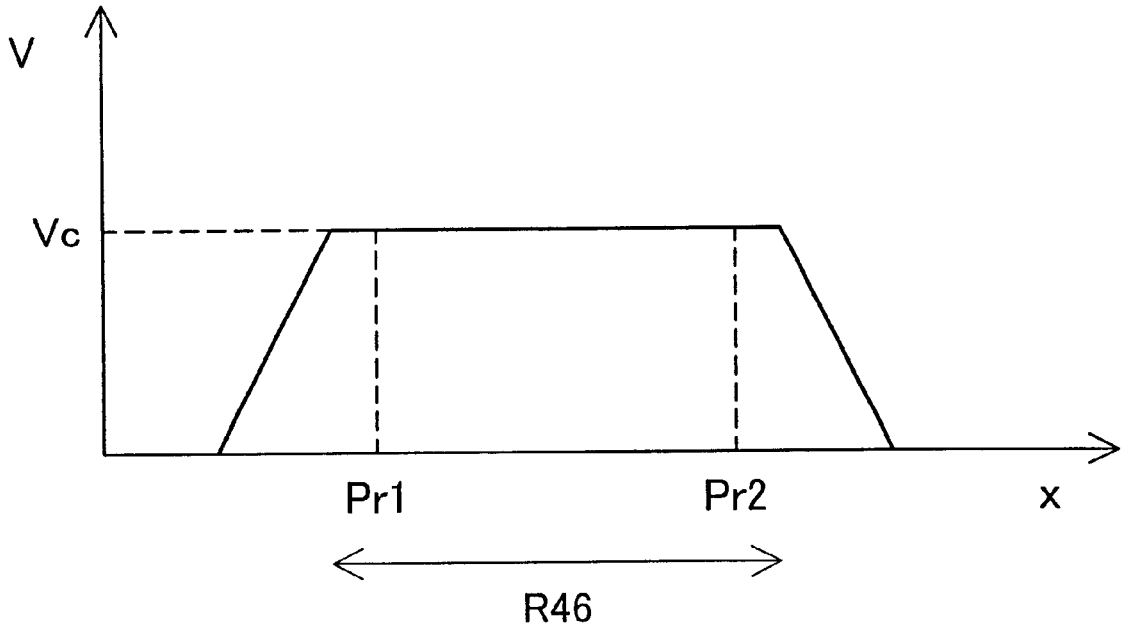
FIG. 9 is a graph showing the changes in carriage velocity when the carriage 28 is moved over the ink receiving area 46 at a fixed speed.

FIG. 9 is a graph showing the changes in carriage velocity when the carriage 28 is moved over the ink receiving area 46 at a fixed speed. The horizontal axis indicates the position (x) of the carriage in the main scanning direction, and the vertical axis indicates the velocity V of carriage movement. R46 indicates the range in which the ink receiving area 46 exists. The velocity of the carriage to which the print head 36 is mounted is increased and decreased in the following manner. As shown in FIG. 9, the print head 36 is accelerated sufficiently in advance of the ink receiving area 46 so that it will be able to move at a fixed speed over the ink receiving area 46, and after it passes the ink receiving area 46, it is decelerated. The laser beam L emitted by the photoemitter 40*a* is emitted such that it traverses the space over the ink receiving area 46.

Reference position marks that the print head 36 can pass at a fixed speed are located on the encoder plate 33 at positions near either end of the ink receiving area 46. In FIG. 9, these reference positions are indicated as Pr1 and Pr2. In the forward pass test and in the reverse pass test described below, the time at which the encoder 29 mounted to the carriage 28 detects either of the reference positions Pr1 or Pr2 for the first time is 'the reference time.' In the forward pass test, Pr1 is detected first. The time in the forward pass test and the reverse pass test is measured as the time elapsed since the reference time. The ink droplet ejection time tf(0) at which it should pass the laser beam L under the default dot formation position misalignment adjustment condition that is set at the time of shipment from the factory is similarly set as the time elapsed since the time that the print head 36 passes the reference position described above (the reference time). The presumed carriage velocity after this passage is similarly a certain velocity Vc.

In the forward pass test, ink droplets are ejected several droplets at a time at the timings of tf(−1), tf(0), tf(1), tf(2) and tf(3), which include, and occur before and after, the time tf(0). These operations are performed by the system controller 54 based on the time information obtained from the timer 58. The positions of the nozzle n0 at each of these timings can be detected by the encoder 29 mounted to the carriage 28. The positions of the nozzle n0 at the times tf(−1), tf(0), tf(1), tf(2) and tf(3) are referred as Pf(−1), Pf(0), Pf(1), Pf(2) and Pf(3), respectively. The forward pass test is carried out by the forward pass test unit 54*a* (see FIG. 5).

If the ink droplet ejection interval and the carriage conveyance velocity are set appropriately relative to the size of the detection region of the laser beam L, ink droplets ejected at one of the timings should cross the laser beam L. Here, the ink droplets ejected at the time tf(2) are set to cross the laser beam L, as shown by the solid line in FIG. 1.

Figure 10:
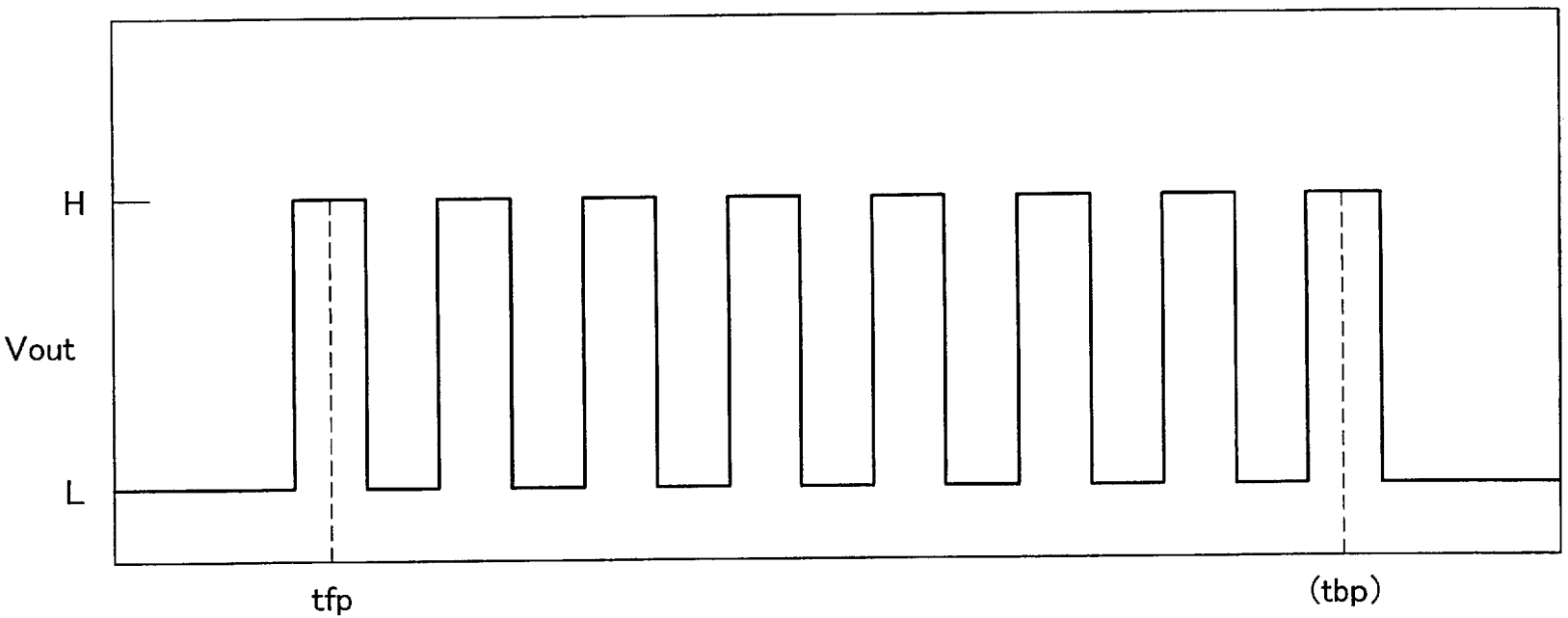
FIG. 10 is a graph showing the output signal Vout from the photoreceptor 40*b;*

FIG. 10 is a graph showing the output signal Vout from the photoreceptor 40*b*. As shown in FIG. 10, when multiple ink droplets (eight droplets in FIG. 10) ejected at the time tf(2) are detected by the photoreceptor 40*b*, the time in the center of the first detection pulse is referred as the 'time at which the ink droplet crossed the laser beam L'. This time is termed $t_{fp}$. The time data indicating $t_{fp}$ concretely is obtained from the timer 58. The ink droplet detection time is determined in the same manner in the test in which the reference condition described above is determined.

When the detection time $t_{fp}$ at which the laser beam L was interrupted is obtained, the time tf(2) at which the ink droplet that crossed the laser beam L was ejected by the nozzle n0 is obtained using the equation below. In the equation, Δt1 is the interval that elapses from the time when the ink droplet that crosses the laser beam L is ejected by the nozzle n0 to the time when it crosses the laser beam L.

$$tf(2)=t_{fp}-\Delta t1 \tag{1}$$

When the ejection direction of the ink droplet ejected from the nozzle n0 is deviated from the perpendicular direction by an angle θ, the velocity component of the ink droplet in the perpendicular direction is the value that is obtained by multiplying the velocity of the ink droplet ejection by cos θ. However, because the offset θ of the ejection direction for the ink droplet ejected from the nozzle n0 is small, cos θ can be thought to be 1. In other words, even when the ink droplet ejection direction is offset slightly, it can be assumed that there is virtually no change in the velocity component of the ink droplet in the perpendicular direction. Therefore, if the velocity component of the ink droplet in the perpendicular direction is to be equal to the velocity Vk (a fixed value) of the ink droplet ejected from the nozzle when the print head is stationary, Δt1 can be calculated as a fixed value from the following equation:

$$\Delta t1=HL/Vk \tag{2}$$

Consequently, in view of equation (2), equation (1) becomes as follows:

$$Tf(2)=t_{fp}-HL/Vk \tag{1'}$$

At the same time, in the reverse pass test, ink droplets are similarly ejected from the nozzle n0 according to a certain cycle while the print head 36 is being conveyed along the reverse pass of main scanning (the direction from right to left in FIG. 1 and FIG. 8). The acceleration and deceleration of the carriage 28 and time measurement are carried out in the same fashion as described in connection with the forward pass test. However, in the reverse pass test, the time elapsed since the print head passes the reference position Pr2 is measured.

The ink droplet ejection time at which the ink droplet should pass the laser beam L, which is calculated in accordance with the default dot formation position misalignment adjustment condition, is referred as tf(0). In the reverse pass test, ink droplets are ejected at the timings of tf(−1), tf(0), tf(1), tf(2) and tf(3), which include, and occur before and after, the time tf(0). These operations are also performed by the system controller 54 based on the time information obtained from the timer 58. The positions of the nozzle n0 at the times tf(−1), tf(0), tf(1), tf(2) and tf(3) are referred as Pf(−1), Pf(0), Pf(1), Pf(2) and Pf(3), respectively. These positions are obtained from the measurement values obtained by the encoder 29 at each of the times described above.

As shown in FIG. 10, when multiple ink droplets (eight droplets in FIG. 10) ejected at the time tb(1) are detected by the photoreceptor 40*b*, the time in the center of the last detection pulse is referred as the 'time at which the ink droplet crosses the laser beam L'. This time is referred as $t_{bp}$. Here, corresponding to the test used to set the standard adjustment condition at the time of shipment from the factory, the time at which the center of the first pulse was detected is to be the detection time in the forward pass test, and the time at which the center of the last pulse was detected is to be the detection time in the reverse pass test. However, so long as the same method of determination as that used in the test to determine the reference condition is used, a different determination method may be used to determine the ink droplet detection time. For example, if the time halfway between the time at which the first-detected pulse rises and the time at which the last-detected pulse disappears is decides to be 'ink droplet detection time' in the test for determining the reference condition, it is preferred that the time halfway between the time at which the first-detected pulse rises and the time at which the last-detected pulse disappears is to be 'ink droplet detection time' in the forward pass test and the reverse pass test as well.

The reverse pass test is carried out by the reverse pass test unit 54*b* (see FIG. 5). Moreover, while the reverse pass test was carried out after the forward pass test in the first embodiment, either test may be carried out first.

If the detection time $t_{bp}$ at which the laser beam L was interrupted by the ink droplet is obtained, the time tb(1) at which the ink droplet that crossed the laser beam L is ejected from the nozzle n0 is expressed via the following equation:

$$tb(\mathbf{1})=t_{bp}-HL/Vk \tag{4}$$

As can be seen from FIG. 1, the position Pf(2) at which the nozzle is located at the time tf(2) in the forward pass test for main scanning, and the position Pb(1) at which the nozzle is located at the time tb(1) in the reverse pass test are the positions at which the ink droplet can actually be ejected toward the laser beam L in the forward and reverse passes of main scanning.

As can be seen from FIG. 1, under the reference condition, the ink droplets ejected aiming the laser beam L in the forward and reverse passes (the ink droplets ejected at times tf(0) and tb(0)), do not actually cross the laser beam L. Therefore, the ejection timing is adjusted as described below. In other words, in the forward pass, the timing of ink droplet ejection is delayed from tf(0) to tf(2). In the reverse pass, the timing of ink droplet ejection is delayed from tb(0) to tb(1). The ink droplets ejected aiming the laser beam in the forward pass and the reverse pass then actually pass through the laser beam L. Therefore, the ink droplet ejection timing adjustment amounts Δta1 for the forward pass and Δta2 for the reverse pass are obtained using the following equations:

$$\Delta ta\mathbf{1}=tf(\mathbf{2})-tf(\mathbf{0}) \tag{5}$$

$$\Delta ta\mathbf{2}=tb(\mathbf{1})-tb(\mathbf{0}) \tag{6}$$

Here, tf(2) and tb(1) are obtained from the equations (1') and (4). In other words, the equations (5) and (6) can be rewritten in the following form:

$$\Delta ta\mathbf{1}=t_{fp}-HL/Vk-tf(\mathbf{0}) \tag{5'}$$

$$\Delta ta\mathbf{2}=t_{bp}-HL/Vk-tb(\mathbf{0}) \tag{6'}$$

In both the adjustment values Δta1 and Δta2 described above, the direction in which an ejection timing is delayed is referred as 'positive'. According to the equations (5') and (6'), the adjustment values Δta1 and Δta2 can be determined based on the measurement values $t_{fp}$ and $t_{bp}$ in the forward and reverse pass tests, the design values HL and Vk, and the calculated values tf(0) and tb(0) obtained under the factory-default dot formation position misalignment adjustment condition.

These adjustment values are based on time, but adjustment values based on position are expressed via the following equations. ΔPa1 is the ejection position adjustment amount in the forward pass, and ΔPa2 is the ejection position adjustment amount in the reverse pass. In either case, the direction of offset in the direction of movement of the carriage 28 is referred as 'positive'.

$$\Delta Pa\mathbf{1}=Pf(\mathbf{2})-Pf(\mathbf{0}) \tag{7}$$

$$\Delta Pa\mathbf{1}=Pb(\mathbf{1})-Pb(\mathbf{0}) \tag{8}$$

Pf(2) can be obtained as the measurement value for the position of the print head at the time tf(2), while Pb(1) can be obtained as the measurement value for the position of the print head at the time tb(1). Therefore, according to the equations (7) and (8), the adjustment values ΔPa1 and ΔPa2 can be set based on the measurement values Pf(2) and Pb(1) in the forward and reverse pass tests and the calculated values Pf(0) and Pb(0) obtained under the factory-default dot formation position misalignment reference condition.

Where the ejection timing can be adjusted for only either the forward pass or reverse pass, the situation can be approached in the following manner. In other words, in order to ensure that corresponding ink droplets make impact at the same spot in both the forward pass and the reverse pass, ink may be ejected such that the ejection position is offset in the direction opposite the direction of movement of the carriage 28 by the distance D1 between the position Pf(2) and Pb(1) (see FIG. 1). In this case, the corresponding ink droplets ejected in the forward and reverse passes, respectively, do not necessarily make impact at a target position, but make impact at the same position. In other words, in order to ensure that the ink droplets make impact at the same position, the ink droplet ejection position can be offset from the impact position in both the forward pass and the reverse pass such that the total amount of this offset may equal D1, or the ink ejection position in either the forward or the reverse pass may be set such that the ink droplet ejection position is offset by an amount D1 relative to the other ejection position.

When determining the adjustment value from the standard adjustment condition based on timing, such value may be determined based on the assumption that all of the adjustment values calculated from the equations (5') and (6') or (7) and (8) are carried out in either the forward or reverse pass. When ejection timing adjustment can be performed only in either the forward pass or reverse pass, the ejection timing adjustment value Δtae is expressed by the following equation:

$$\Delta tae=\Delta ta\mathbf{1}+\Delta ta\mathbf{2} \tag{9}$$

Δtae can be calculated from only Δta1 and Δta2. Consequently, like Δta1 and Δta2, Δtae can be determined based on the measurement values $t_{fp}$ and $t_{bp}$ in the forward and reverse pass tests, the design values HL and Vk, and the calculated values tf(0) and tb(0) obtained under the factory-default dot formation position misalignment adjustment condition. The equation (9) can be expressed in the following form using the equations (5') and (6'):

$$\Delta tae=t_{fp}-tf(\mathbf{0})+tpb-tb(\mathbf{0})-2HL/Vk \tag{9'}$$

The ejection position adjustment value ΔPae where ejection timing adjustment can be performed only in either the forward pass or reverse pass can be calculated from (ΔPa1+ΔPa2). This adjustment value ΔPae can be expressed as follows using the equations (7) and (8):

$$\Delta Pae=Pf(\mathbf{2})-Pf(\mathbf{0})+Pb(\mathbf{1})-Pb(\mathbf{0}) \tag{10}$$

Like ΔPa1 and ΔPa2, the adjustment value ΔPae can be determined based on the measurement values Pf(2) and Pb(1) for the forward and reverse pass tests and the calculated values Pf(0) and Pb(0) obtained under the factory-default dot formation position misalignment reference condition.

If the ink droplet ejection timing adjustment values or the ejection position adjustment values are set as described above, the printing apparatus can simply and automatically set the adjustment values without the need for visual review by the user. The calculation of the adjustment values here is carried out by the adjustment value determining unit 54*c* (see FIG. 5). In addition, the preset values HL, Vk, tf(0), tb(0), Pf(0) and Pb(0) are stored in the PROM 57 and are extracted by the system controller 54 when the adjustment values are calculated. In other words, the PROM 57 is correspond to the 'memory' described in the claims. The measurement values such as $t_{fp}$ and $t_{bp}$ and the values derived therefrom are stored in the main memory 56 and are used to calculate the adjustment values. Furthermore, it is acceptable if the values tf(0), tb(0), Pf(0) and Pb(0) are not pre-stored in the PROM 57, and instead are calculated every time the inspection is performed.

In the first embodiment, the carriage 28 is moved at a fixed speed in the forward pass test and the reverse pass test. Accordingly, the adjustment values can be easily calculated.

Figure 11:
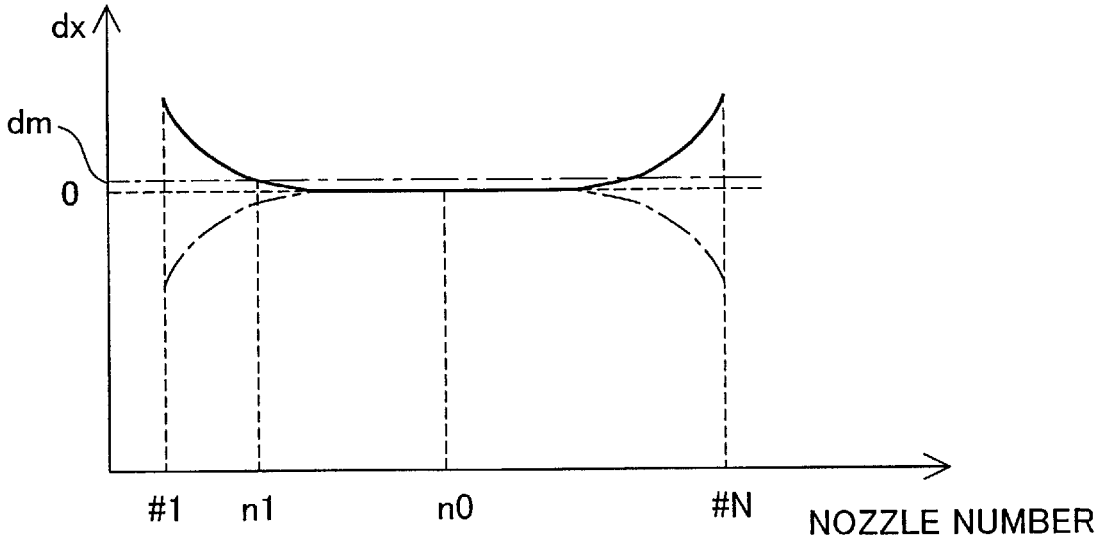
FIG. 11 is a graph showing the impact position misalignment dx for each nozzle in the nozzle array.

FIG. 11 is a graph showing the impact position misalignment dx for each nozzle in the nozzle array. In FIG. 11, one example of the impact position misalignment for each nozzle in the nozzle array is indicated by a solid line, and another example is indicated by a chain-dot line. As shown in FIG. 11, in general, a relatively large number of nozzles in the center area of the nozzle array have a relatively small impact position misalignment dx, while the nozzles at the ends of the array have a relatively large misalignment dx. In this embodiment, the nozzle used for the ejection tests to set the adjustment value is the nozzle n0 located in the center of the nozzle array. As a result, the ink drop ejection timing adjustment value can be set using a nozzle that conforms to the same performance tendencies as most of the nozzles in the nozzle array. Therefore, adjustment value appropriate for most of the nozzles can be determined, enabling high-quality printing results to be achieved.

Alternatively, it is also acceptable if the ejection tests are performed using a nozzle other than the center nozzle n0. If the ejection tests are performed using a nozzle n1 having an impact position misalignment amount close to the average offset amount value dm for all of the nozzles in the nozzle array, the average ink droplet impact position misalignment dm for the nozzle array as a whole can be made small.

In this embodiment, the nozzle used in the position misalignment adjustment tests is the nozzle n0 positioned in the center of the nozzle array. Accordingly, even when the optical axis of the laser beam L is oriented at a prescribed angle to the nozzle array, the relationship between the laser beam optical axis and the nozzle in the forward pass of main scanning can be symmetric with the relationship between the laser beam optical axis and the nozzle n0 in the reverse pass of main scanning. Therefore, the adjustment value can be determined easily.

In the first embodiment, the forward pass test and the reverse pass test are carried out by moving the carriage 28 while ink droplets are ejected. As a result, the position of the carriage when ink droplets crossing the laser beam L are ejected and the time of such ink droplet ejection can be identified within a short period of time. In the first embodiment, the carriage 28 is moved at a fixed speed in both the forward pass and the reverse pass. Consequently, the adjustment value can be determined easily. Determination of the adjustment value is also made easy by the fact that ink droplets are ejected from the nozzle n0 according to a fixed cycle.

In this embodiment, where multiple ink droplets are detected by the photoreceptor 40*b*, the detection time $t_{fp}$ is determined in the forward pass test based on the initial pulse, while the detection time $t_{bp}$ is determined in the reverse pass test based on the final pulse. As a result, adjustment values by which the ink droplet impact positions for the forward pass and reverse pass can be accurately matched can be determined. Alternatively, it is acceptable if the detection time $t_{fp}$ is determined in the forward pass test based on the final pulse and the detection time $t_{bp}$ is determined in the reverse pass test based on the initial pulse. In other words, where multiple ink droplets are detected by the photoreceptor 40*b*, it is acceptable if the detection time $t_{fp}$ is determined in the forward pass test based on either the initial pulse or the final pulse and the detection time $t_{bp}$ is determined in the reverse pass test based on the other pulse.

Figure 12:
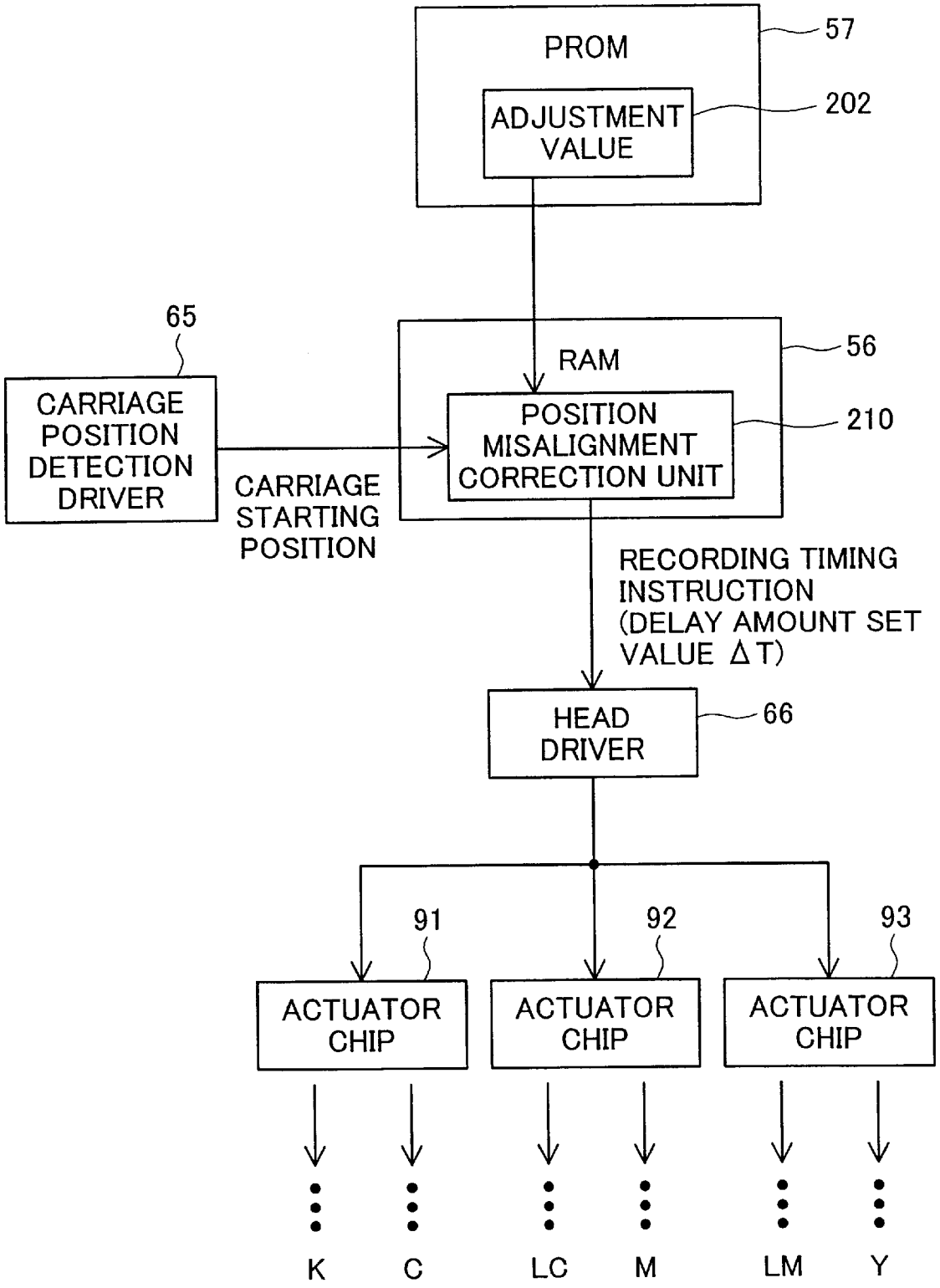
FIG. 12 is a block diagram showing the main components related to offset correction during bi-directional printing.

B-5. Ink Droplet Ejection Timing Adjustment in Reverse Pass:

FIG. 12 is a block diagram showing the main components related to misalignment correction during bi-directional printing. An adjustment value storage area 202 is located in the PROM 57 in the printer 20. The desirable adjustment values determined in the above process are stored in this adjustment value storage area 202. In the first embodiment, ink droplet ejection timing adjustment is performed only in the reverse pass, and the adjustment value stored in the adjustment value storage area 202 is the adjustment value Δtae set in accordance with the equation (9').

A computer program having a function of a position misalignment correction unit 210 to correct position misalignment in bi-directional printing is stored in the main memory 56 of the printer 20. This position misalignment correction unit 210 extracts the adjustment value from the adjustment value storage area 202. Signals to instruct head recording timing are then supplied to the head driver 66 based on this adjustment value.

The head driver 66 supplies identical drive signals to three actuator chips 91–93. The ink droplet ejection timing for the reverse pass is adjusted by the head driver 66 in accordance with the recording timing (i.e., the determined delay amount value Δtae) supplied by the position misalignment correction unit 210. Consequently, the dot recording positions for the six nozzle arrays are adjusted in the reverse pass by the same correction mount.

C. Second Embodiment:

In the first embodiment, the ink droplet ejection times tf(2) and tb(1) (see FIG. 1) are calculated from the times $t_{fp}$ and $t_{bp}$ in which the laser beam L is interrupted in the forward and reverse passes. The adjustment values Δta1, Δta1, ΔPa1 and ΔPa2 are then calculated. However, the adjustment values may be obtained using a different method. For example, the position Pf(p) of the carriage 28 at the laser light L passage detection time $t_{fp}$ in the forward pass test is calculated or measured. At the same time, the expected position of the carriage 28 at the detection time $t_{fp}$ under the default dot formation position misalignment adjustment condition is to be Pfr(p). In this case, the adjustment value ΔPa1 may be calculated using the following equation:

$$\Delta Pa1 = Pf(p) - Pfr(p) \tag{11}$$

Similarly, ΔPa2 and ΔPae can be calculated using the equations below. Here, Pb(p) is the position of the carriage 28 at the laser beam L passage detection time $t_{bp}$ in the reverse pass test, and Pbr(p) is the expected position of the carriage 28 at the detection time $t_{bp}$ calculated under the reference condition.

$$\Delta Pa2=Pb(p)-Pbr(p) \quad (12)$$

$$\Delta Pae=Pf(p)-Pfr(p)+Pb(p)-Pbr(p) \quad (13)$$

In the above equations, if the ink droplet ejection position is moved in the direction of movement of the carriage 28, that correction is to be made in the 'positive' direction. Furthermore, Δta1, Δta2 and Δtae can be calculated using the equations below. In the equations below, Vc is the speed of movement of the carriage 28 in the forward pass test and the reverse pass test. In each equation, the direction of delay of the ink droplet ejection timing is referred as 'positive'.

$$\Delta ta1=(Pf(p)-Pfr(p))/Vc \quad (14)$$

$$\Delta ta1=(Pb(p)-Pbr(p))Vc \quad (15)$$

$$\Delta tae=(Pf(p)-Pfr(p)+Pb(p)-Pbr(p))/Vc \quad (16)$$

The adjustment values may be appropriately determined in this embodiment as well.

Figure 13:
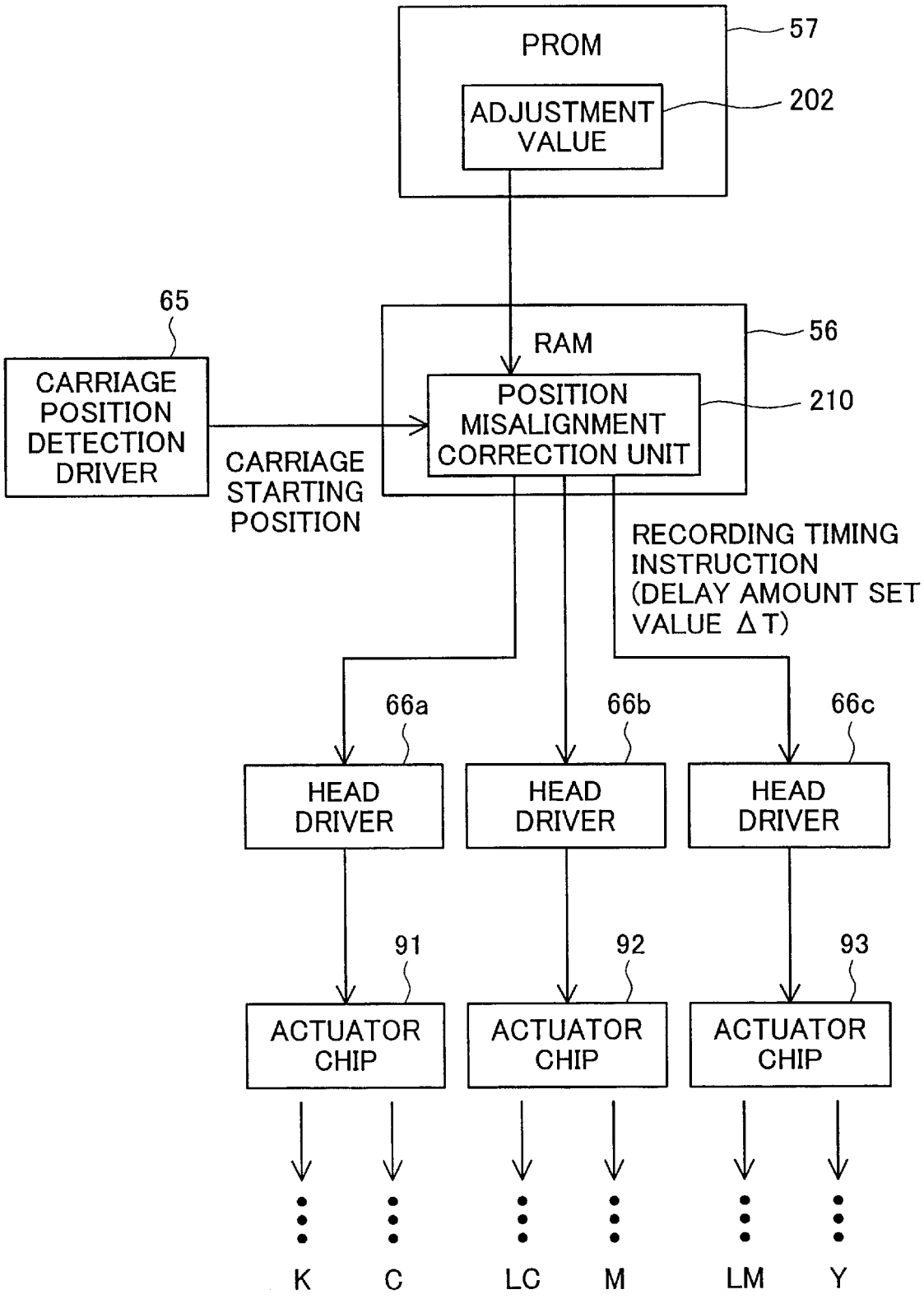
FIG. 13 is a block diagram showing the main components pertaining to offset correction during printing in a third embodiment.

D. Third Embodiment:

FIG. 13 is a block diagram showing the main components pertaining to misalignment correction during printing in a third embodiment. The construction in this block diagram is the same as that in the block diagram of FIG. 12, except for the head driving circuit and the actuator chips. In the printing apparatus of the third embodiment, the actuator chips have independent head drivers 66*a*–66*c*, respectively. As a result, the ink droplet ejection timing can be adjusted independently for black and dark cyan, light cyan and dark magenta, and light magenta and yellow, respectively. In this printing apparatus, it is preferred that the forward pass test and the reverse pass test shown in FIG. 1 and FIG. 8 be carried out for the nozzle arrays driven by each respective actuator chip. In this embodiment, the quality of the printing can be further increased.

E. Fourth Embodiment:

In the first embodiment, the height position of the laser beam L was equal to the height position of the printing paper P placed on the platen. However, in the fourth embodiment, the two height positions are different. The fourth embodiment is identical to the first embodiment in all other respects.

Figure 14:
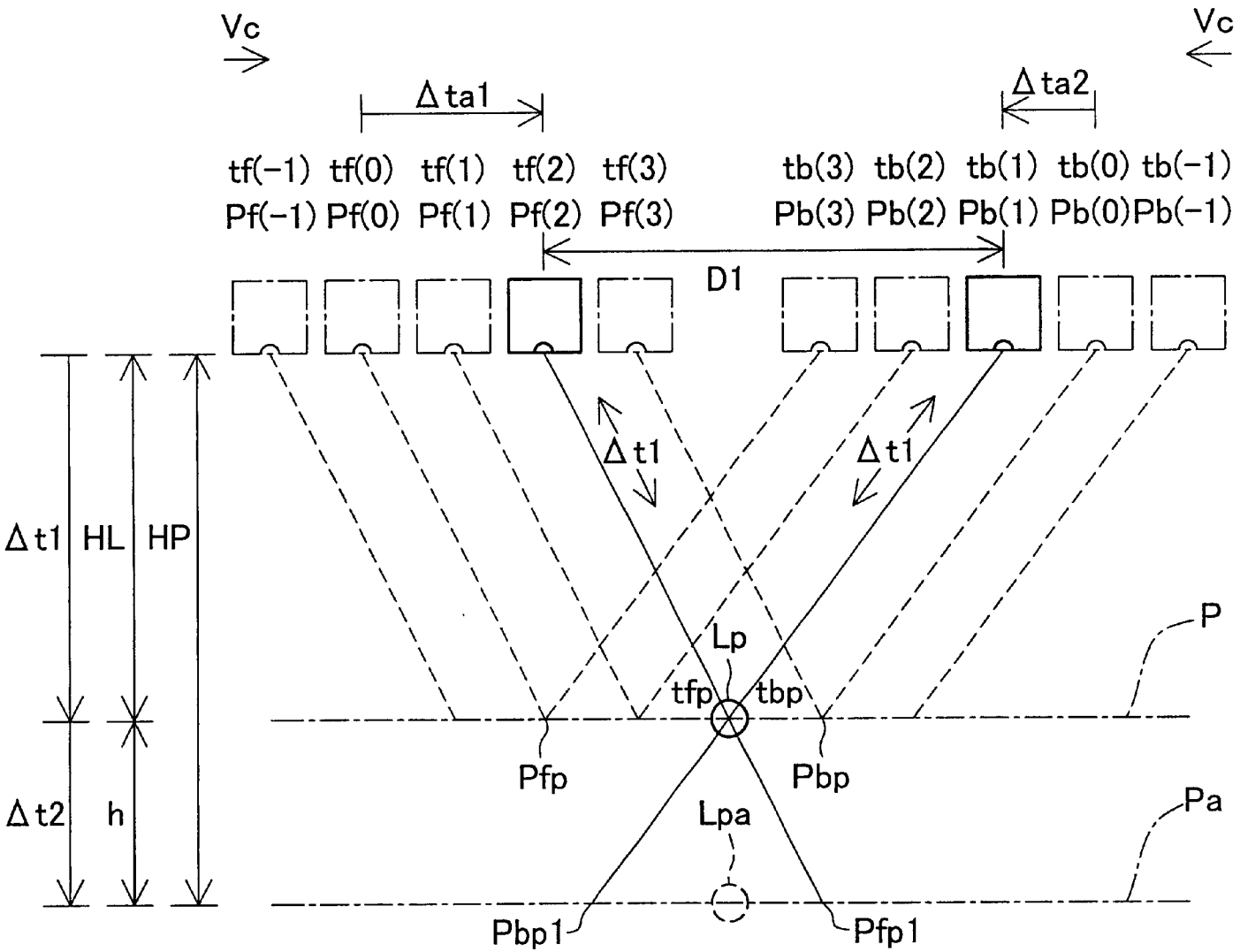
FIG. 14 is an explanatory drawing showing the forward pass test and the reverse pass test carried out in the fourth embodiment.

FIG. 14 is an explanatory drawing showing the forward pass test and the reverse pass test carried out in the fourth embodiment. The distance between the printing paper Pa and the bottom surface of the print head 36 in the fourth embodiment is referred as HP. In FIG. 14, the position of the printing paper Pa is indicated hypothetically by a chain-dot line. At the height of the printing paper Pa, the position equivalent to the center area of the laser beam L in the sub-scanning direction is indicated as Lpa.

If an ink droplet is ejected at the ejection timing tf(2) in the forward pass and at the ejection timing tb(1) in the reverse pass, each ink droplet passes through the center area Lp of the laser beam L. However, as shown in FIG. 14, these ink droplets do not pass through the same point at the height of the printing paper Pa. In order to have the ink droplet make impact at the point Lpa at the height of the printing paper Pa in the forward pass, the ink droplet must be ejected earlier than the time tf(2). The time Δt2 that elapses from the time in which the ink droplet passes the height P to the time in which it reaches the paper Pa is expressed via the equation below. HP is stored in the PROM 57.

$$\Delta t2=(HP-HL)/Vk \quad (21)$$

Therefore, the ink ejection adjustment value Δta3 in the forward pass can be determined via the following equation:

$$\Delta ta3=\Delta ta1-\Delta t2 \quad (22)$$

The equation (22) can be expressed in the following form using the equations (5') and (21):

$$\Delta ta3=t_{fp}-HP/Vk-tf(0) \quad (22')$$

Similarly, the ink ejection adjustment value Δta4 in the reverse pass can be determined via the following equation:

$$\Delta ta4=t_{bp}-HP/Vk-tb(0) \quad (23)$$

The distance HP between the printing paper Pa and the bottom surface of the print head 36 can be calculated from the distance between the bottom surface of the print head and the platen and the thickness of printing paper. Therefore, in accordance with the equations (22') and (23), the adjustment values Δta3 and Δta4 can be determined based on the measurement values $t_{fp}$ and $t_{bp}$ in the forward pass test and the reverse pass test, the design value Vk, the calculated values tf(0) and tb(0) obtained from the factory-default dot formation position misalignment adjustment condition, and the distance HP obtained based on the design values.

Where ejection timing adjustment can be carried out in only the forward pass or the reverse pass, the ejection timing adjustment value Δtaf, being obtained from (Δta3+Δta4). Accordingly the ejection timing adjustment value Δtaf can be expressed via the following equation:

$$\Delta taf=t_{fp}-tf(0)+t_{bp}-tb(0)-2HP/Vk \quad (24)$$

Furthermore, the forward pass ejection position adjustment value ΔPa3 is obtained from (ΔPa1−Δt2×Vc). Here, Vc is the speed at which the carriage 28 is conveyed during main scanning. In this embodiment, the carriage 28 is conveyed relative to the printing paper P, but when the printing paper P is conveyed relative to the carriage 28 in main scanning, Vc is the conveyance speed of the printing paper P during main scanning. In other words, Vc is the relative speed of the print head vis-a-vis the printing medium in main scanning. At the same time, the reverse pass ejection position adjustment value ΔPa4 is obtained from (ΔPa2−Δt2×Vc). Therefore, the adjustment values ΔPa3 and ΔPa4 can be expressed via the following equations:

$$\Delta Pa3=(Pf(2)-Pf(0))-t2\times Vc=(Pf(2)-Pf(0))-(HP/HL)\times Vc/Vk \quad (25)$$

$$\Delta Pa4=(Pb(1)-Pb(0))-\Delta t2Vc=(Pb(1)-Pb(0))-(HP-HL)\times Vc/Vk \quad (26)$$

When the ejection timing is adjusted only for either the forward pass or the reverse pass, the ejection position adjustment value ΔPaf can be obtained from (ΔPa3+ΔPa4). Accordingly, it can be expressed via the following equation:

$$\Delta Paf=(Pf(2)-Pf(0)+Pb(1)-Pb(0))-(HP-HL)\times 2Vc/Vk \quad (27)$$

Furthermore, when HP=HL, the equation (22') is equivalent to the equation (5'), the equation (23) is equivalent to the equation (6'), and the equation (24) is equivalent to the equation (9'). Similarly, the equation (25) is equivalent to the equation (7), the equation (26) is equivalent to the equation (8), and the equation (27) is equivalent to the equation (10).

When the ejection timing adjustment values and ejection position adjustment values are determined as described above, appropriate adjustment values can be determined even when the distance HL between the nozzle and the laser beam L is different from the distance HP between the nozzle and the printing paper Pa. Furthermore, where the thickness of the printing paper varies depending on the type of printing paper, if multiple values for HP are stored beforehand in the PROM 57 based on the type of printing paper, adjustment values corresponding to the type (thickness) of the printing paper can be determined.

In addition, when the position of the carriage 28 is measured as described in connection with the second embodiment, the values ΔPa3, ΔPa4 and ΔPaf can be calculated using the following equations:

$$\Delta Pa3=(Pf(p)-Pfr(p))-(HP-HL)\times Vc/Vk \quad (28)$$

$$\Delta Pa4=(Pb(p)-Pbr(p))-(HP-HL)\times Vc/Vk \quad (29)$$

$$\Delta Paf=(Pf(p)-Pfr(p)+Pb(p)-Pbr(p))-(HP-HL)\times 2Vc/Vk \quad (30)$$

Furthermore, when HP=HL, the equation (28) is equivalent to the equation (11), the equation (29) is equivalent to the equation (12), and the equation (30) is equivalent to the equation (13). If the ink droplet ejection timing adjustment values and ejection position adjustment values are determined as described above, appropriate adjustment values can be determined even when the distance HL between the nozzle and the laser beam L is different from the distance HP between the nozzle and the printing paper Pa.

F. Variations:

The present invention in not limited to the embodiments described above, and various other variations may be implemented within the scope thereof. For example, the variations described below are possible.

F-1. Variation 1:

In these embodiments, the nozzle group that ejects single-color ink is a nozzle array that comprised nozzles aligned in rows. But the nozzle arrangement is not limited thereto. In other words, any combination of nozzles that eject ink is acceptable.

F-2. Variation 2:

In these embodiments, position misalignment is corrected by adjusting the ink droplet ejection timing or the carriage position during ink droplet ejection in the reverse pass only. But it is also acceptable if position misalignment is corrected by adjusting the ink droplet ejection timing or the carriage position during ink droplet ejection in the forward pass only. It is furthermore acceptable if position misalignment is corrected by adjusting the ink droplet ejection timing in both the forward pass and the reverse pass. In other words, in general, it is acceptable if position misalignment is corrected by adjusting the ink droplet ejection timing in at least one of the forward pass and the reverse pass.

F-3. Variation 3:

In the various embodiments described above, the description involves an inkjet printer, but the present invention is not limited to an inkjet printer, and may generally be applied in any printing apparatus that performs printing using a print head. Moreover, the present invention is not limited to a method or apparatus that ejects ink droplets, and may be applied in a method or apparatus that records dots by some other means.

F-4. Variation 4:

Some of the components that are realized via hardware in the various embodiments described above may instead be achieved via software, and vice versa. For example, some of the functions of the various drivers shown in FIG. 5 can be realized via software.

Although the present invention has been described and illustrated in detail, it is clearly understood that the same is by way of illustration and example only and is not to be taken by way of limitation, the spirit and scope of the present invention being limited only by the terms of the appended claims.

What we claimed is:

1. An method for determining an adjustment value used to reduce dot formation position misalignment in a main scanning direction where printing is performed using a printing apparatus having a print head that includes nozzles for ejecting ink droplets onto a printing medium while carrying out bi-directional main scanning in which at least one of the print head and the printing medium is moved, the method comprising the steps of:

(a) providing an inspection unit for optical detection of passage of ink droplets ejected from a nozzle;

(b) carrying out a forward pass test to detect the ink droplets using the inspection unit while ejecting ink droplets from the nozzle and moving the print head in a forward pass of the main scanning;

(c) carrying out a reverse pass test to detect the ink droplets using the inspection unit while ejecting ink droplets from the nozzle and moving the print head in a reverse pass of the main scanning; and (d) determining the adjustment value based on the results of the forward pass test and the reverse pass test.

2. A method according to claim 1, wherein the step (b) comprises a step of identifying a detection time $t_{fp}$ at which the ink droplets were detected by the inspection unit, the step (c) comprises a step of identifying a detection time $t_{bp}$ at which the ink droplets were detected by the inspection unit, and the step (d) comprises a step of determining the adjustment value using the detection time $t_{fp}$ and the detection time $t_{bp}$.

3. A method according to claim 2, wherein the step (d) comprises a step of calculating the adjustment value based on:

a reference eject time $t_{f0}$ of the ink droplet is to be identified by the inspection unit in the forward pass test under a reference condition of the dot formation position misalignment adjustment;

a reference eject time $t_{b0}$ of the ink droplet is to be identified by the inspection unit in the reverse pass test under the reference condition;

the detection time $t_{fp}$, and $t_{bp}$;

a distance HP between a particular nozzle and a surface of the printing medium when the particular nozzle is positioned facing the printing medium; and an ink droplet velocity component Vk in a direction connecting a nozzle to be inspected and a detection position of the inspection unit when the nozzle to be inspected is closest to the detection position.

4. A method according to claim 1, wherein the step (b) comprises a step of identifying a position $P_{fp}$ of the nozzle at the detection time $t_{fp}$ at which the ink droplets were detected by the inspection unit in the forward pass test, the step (c) comprises a step of identifying a position $P_{bp}$ of the nozzle at the detection time $t_{bp}$ at which the ink droplets were detected by the inspection unit in the reverse pass test, and the step (d) comprises a step of determining the adjustment value using the position $P_{fp}$ and the position $P_{bp}$.

5. The adjustment value determination method according to claim 4, wherein the step (d) comprises a step of calculating the adjustment value based on:

a reference position $P_{f0}$ at which the nozzle ejects the ink droplet that is to be identified by the inspection unit in the forward pass test under a reference condition of the dot formation position misalignment adjustment;

a reference position $P_{b0}$ at which the nozzle ejects the ink droplet that is to be identified by the inspection unit in the reverse pass test under the reference condition;

the position $P_{fp}$, and $P_{bp}$;

a distance HP between a particular nozzle and a surface of the printing medium when the particular nozzle is positioned facing the printing medium;

a shortest distance HL between the nozzle and a detection position of the inspection unit;

an ink droplet velocity component Vk in a direction connecting the nozzle and the detection position when the nozzle is closest to the detection position; and a relative velocity Vc of the print head relative to the printing medium during the main scanning.

6. A printing apparatus that performs printing by ejection of ink droplets from nozzles that includes:

a print head having nozzles that eject ink droplets;

an inspection unit that optically detects a passage of ink droplets ejected from one of the nozzles;

a head driving unit that drives the nozzles to eject ink droplets;

a main scanning driving unit that performs main scanning in which the print head is moved relative to the inspection unit;

a timer; and a controller that controls the print head, the inspection unit, the head driving unit, the main scanning driving unit and the timer, wherein the controller includes a forward pass test unit that causes one of the nozzles to eject ink droplets while moving the print head in a forward pass of the main scanning, and carries out a forward pass test in which the ink droplets are detected by the inspection unit, a reverse pass test unit that causes one of the nozzles to eject ink droplets while moving the print head in a reverse pass of the main scanning, and carries out a reverse pass test in which the ink droplets are detected by the inspection unit, and an adjustment value determination unit that determines an adjustment value based on the results of the forward pass test and the reverse pass test.

7. A printing apparatus according to claim 6, wherein the forward pass test unit is configured to identify a detection time $t_{fp}$ at which the ink droplets were detected by the inspection unit, the reverse pass test unit is configured to identify a detection time $t_{bp}$ at which the ink droplets were detected by the inspection unit, and the adjustment value determination unit determines the adjustment value using the detection time $t_{fp}$ and the detection time $t_{bp}$.

8. A printing apparatus claimed in claim 7, further including a memory that stores:

a reference eject time $t_{f0}$ of the ink droplet is to be identified by the inspection unit in the forward pass test under a reference condition of the dot formation position misalignment adjustment;

a reference eject time $t_{b0}$ of the ink droplet is to be identified by the inspection unit in the reverse pass test under the reference condition;

a distance HP between a particular nozzle and a surface of a printing medium when the particular nozzle is positioned facing the printing medium; and an ink droplet velocity component Vk in a direction connecting a nozzle to be inspected and a detection position of the inspection unit when the nozzle to be inspected is closest to the detection position.

9. A printing apparatus claimed in claim 6, further including a position sensor that detects a position of the print head during the main scanning, wherein the forward pass test unit is configured to identify a position $P_{fp}$ of the nozzle at the detection time $t_{fp}$ at which the ink droplets were detected by the inspection unit in the forward pass test, the reverse pass test unit is configured to identify a position $P_{bp}$ of the nozzle at the detection time $t_{bp}$ at which the ink droplets were detected by the inspection unit in the reverse pass test, and the adjustment value determination unit determines the adjustment value using the position $P_{fp}$ and the position $P_{bp}$.

10. A printing apparatus claimed in claim 9, further including a memory that stores:

a reference position $P_{f0}$ at which the nozzle ejects the ink droplet that is to be identified by the inspection unit in the forward pass test under a reference condition of the dot formation position misalignment adjustment;

a reference position $P_{b0}$ at which the nozzle ejects the ink droplet that is to be identified by the inspection unit in the reverse pass test under the reference condition;

a distance HP between a particular nozzle and a surface of a printing medium when the particular nozzle is positioned facing the printing medium;

a shortest distance HL between the nozzle and a detection position of the inspection unit;

an ink droplet velocity component Vk in a direction connecting the nozzle and the detection position when the nozzle is closest to the detection position; and a relative velocity Vc of the print head relative to the printing medium during the main scanning.

11. A computer program product for determining an adjustment value used to reduce dot formation position misalignment in a main scanning direction using a computer, the computer being connected with a printing apparatus having a print head and an inspection unit, the print head including nozzles for ejecting ink droplets onto a printing medium while bi-directional main scanning in which at least one of the print head and the printing medium is moved, the inspection unit detecting passage of ink droplet ejected from the nozzle, wherein the computer program product comprising:

a computer readable medium; and a computer program stored on the computer readable medium, the computer program comprising:

a forward pass test program for causing the computer to carry out a forward pass test to detect the ink droplets by ejecting ink droplets from the nozzle while moving the print head in a forward pass of the main scanning;

a reverse pass test program for causing the computer to carry out a reverse pass test to detect the ink droplets by ejecting ink droplets from the nozzle while moving the print head in a reverse pass of the main scanning; and an adjustment value determination program for causing the computer to determine the adjustment value based on the results of the forward pass test and the reverse pass test.

12. A computer program product according to claim 11, wherein the forward pass test program includes a first program for causing the computer to identify a detection time $t_{fp}$ at which the ink droplets were detected by the inspection unit, the reverse pass test program includes a second program for causing the computer to identify a detection time $t_{bp}$ at which the ink droplets were detected by the inspection unit, and the adjustment value determination program includes a third program for causing the computer to determine the adjustment value using the detection time $t_{fp}$ and the detection time $t_{bp}$.

13. A computer program product according to claim 12, wherein the third program is configured to cause the computer to calculate the adjustment value further based on:

a reference eject time $t_{f0}$ of the ink droplet is to be identified by the inspection unit in the forward pass test under a reference condition of the dot formation position misalignment adjustment;

a reference eject time $t_{b0}$ of the ink droplet is to be identified by the inspection unit in the reverse pass test under the reference condition;

the detection time $t_{fp}$, and $t_{bp}$;

a distance HP between a particular nozzle and a surface of the printing medium when the particular nozzle is positioned facing the printing medium; and an ink droplet velocity component Vk in a direction connecting a nozzle to be inspected and a detection position of the inspection unit when the nozzle to be inspected is closest to the detection position.

14. A computer program product according to claim 11, wherein the forward pass test program further includes a first program for causing the computer to identify a position $P_{fp}$ of the nozzle at a detection time $t_{fp}$ at which the ink droplets were detected by the inspection unit in the forward pass test, the reverse pass test program includes a second program for causing the computer to identify a position $P_{bp}$ of the nozzle at the detection time $t_{bp}$ at which the ink droplets were detected by the inspection unit in the reverse pass test, and the adjustment value determination program includes a third program for causing the computer to determine the adjustment value using the position $P_{fp}$ and the position $P_{bp}$.

15. A computer program product according to claim 14, wherein the third program is configured to cause the computer to calculate the adjustment value further based on:

a reference position $P_{f0}$ at which the nozzle ejects the ink droplet that is to be identified by the inspection unit in the forward pass test under a reference condition of the dot formation position misalignment adjustment;

a reference position $P_{b0}$ at which the nozzle ejects the ink droplet that is to be identified by the inspection unit in the reverse pass test under the reference condition;

the position $P_{fp}$, and $P_{bp}$;

a distance HP between a particular nozzle and a surface of the printing medium when the particular nozzle is positioned facing the printing medium;

a shortest distance HL between the nozzle and a detection position of the inspection unit;

an ink droplet velocity component Vk in a direction connecting the nozzle and the detection position when the nozzle is closest to the detection position; and a relative velocity Vc of the print head relative to the printing medium during the main scanning.

* * * * *